United States Patent [19]

Frewin

[11] 4,165,277

[45] Aug. 21, 1979

[54] ARTICLE MONITORING AND REJECT APPARATUS

[75] Inventor: Le Roy F. Frewin, Arvada, Colo.

[73] Assignee: Inex, Incorporated, Denver, Colo.

[21] Appl. No.: 771,879

[22] Filed: Feb. 25, 1977

[51] Int. Cl.[2] ..... B07C 5/342

[52] U.S. Cl. ..... 209/3.3; 209/526; 209/564; 209/577; 250/223 B; 356/240

[58] Field of Search ..... 209/73, 74 R, 111.5, 209/111.7 R, 111.7 T, 523, 522, 524, 526, 563, 564, 577; 250/223 B, 563; 356/240

[56] References Cited

U.S. PATENT DOCUMENTS

| | | | |
|---|---|---|---|
| 2,904,174 | 9/1959 | Emerson | 209/111.7 R |
| 3,245,533 | 4/1966 | Rottmann | 209/111.7 T |
| 3,263,809 | 8/1966 | Mandula et al. | 209/81 R X |
| 3,386,578 | 6/1968 | Black et al. | 209/111.7 R |
| 3,812,349 | 5/1974 | Gugliotta et al. | 209/111.7 R X |
| 3,835,332 | 9/1974 | Bridges | 250/563 |
| 3,980,890 | 9/1976 | Heckrodt et al. | 250/223 B X |
| 4,026,414 | 5/1977 | Ellinger | 209/111.7 R |
| 4,026,656 | 5/1977 | Kusz et al. | 250/223 B X |

*Primary Examiner*—Joseph J. Rolla

*Attorney, Agent, or Firm*—O'Rourke & Harris

[57] ABSTRACT

An article monitoring and reject apparatus is disclosed that is particularly well suited for monitoring or inspecting glass containers and automatically rejecting defective containers. The system includes a monitoring unit having a plurality of scan diodes and associated phototransistors with each diode being individually caused to emit a plurality of light pulses and the diodes being successively energized to scan that portion of the article to be monitored. The associated phototransistor produces a plurality of electrical pulses when a defect is sensed, as indicated by light reflected from the portion of the article then being monitored, and a defect signal is produced only if a predetermined plurality of pulses are generated from each of a plurality of diodes indicative of a defect. An inspection window is established by a separate light emitter and sensor at the monitoring area and the signal produced is processed in dual paths to reject device circuitry. A reject sensor is also provided by a separate light emitter and sensor and a signal therefrom is coupled to the reject circuitry which enables automatic rejection of an article sensed to be defective.

26 Claims, 18 Drawing Figures

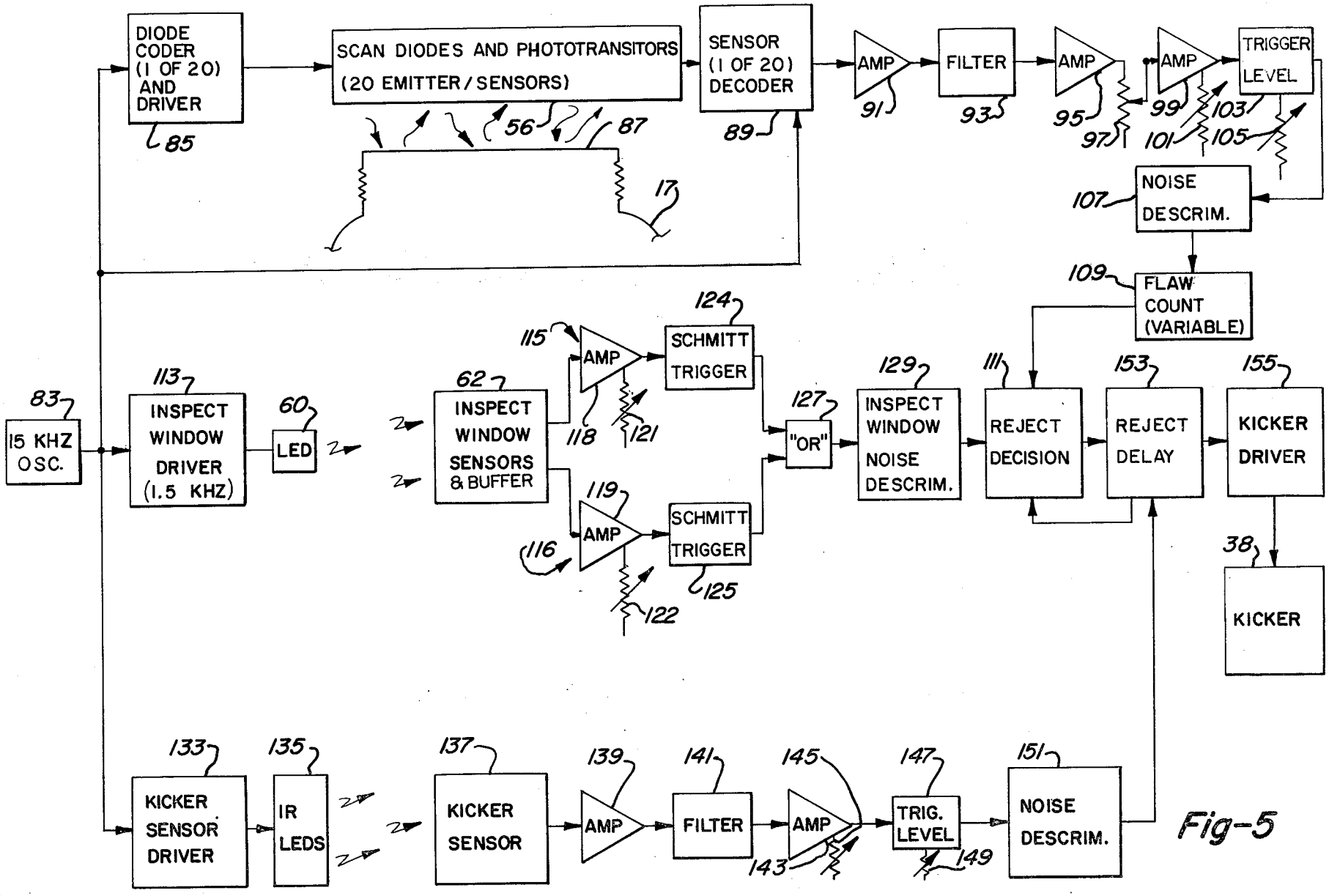
TRIGGER LEVEL
AMP
AMP
FILTER
AMP
SENSOR (1 OF 20) DECODER
SCAN DIODES AND PHOTOTRANSITORS (20 EMITTER/SENSORS)
DIODE CODER (1 OF 20) AND DRIVER
NOISE DESCRIM.
FLAW COUNT (VARIABLE)
KICKER DRIVER
KICKER
REJECT DELAY
REJECT DECISION
INSPECT WINDOW NOISE DESCRIM.
"OR"
SCHMITT TRIGGER
SCHMITT TRIGGER
AMP
AMP
INSPECT WINDOW SENSORS & BUFFER
LED
INSPECT WINDOW DRIVER (1.5 KHZ)
15 KHZ OSC.
NOISE DESCRIM.
TRIG. LEVEL
AMP
FILTER
AMP
KICKER SENSOR
IR LEDS
KICKER SENSOR DRIVER
Fig-5

+5V
RESET
113
456
455
457
599
601
603
602
ONE SHOT
598
13-12
13-10
607
KICKER
606
605
612
614
609
610
618
619
620
615
613

460
451
450
452
453
454
FLAW
434
438
437
436
435
A
B
C
D
PROGRAMABLE DIVIDER
432
LOAD
430
DETECT
446
447
440
443
444
442
347
346
343
344
342
81US
331
326
330
10-9
340
339
SCAN
333
332
334
10MS
327
336
337
328

(a)
(b)
(c)
(d)
2 VDC Av≈1
2.5 VDC Av≈2.5
2.5VDC Av≈20
SHIELD
KICKER SENSOR
KICKER SENSOR C
IR LED
VISIBLE
ONE SHOT
15 KHZ
+5V HI
HI GND
+5V LO
LO GND
TO +5V
TO 12-13
J6
13-3
13-4
13-5
13-7
13-11
13-12
13-13
13-14
13-15
34

ARTICLE MONITORING AND REJECT APPARATUS

FIELD OF THE INVENTION

This invention relates to a system for monitoring articles for defects, and more particularly, relates to a monitoring and reject system for articles such as glass containers.

BACKGROUND OF THE INVENTION

It is oftentimes desirable to monitor articles and to reject the articles found to be defective. Such is the case, for example, where glass containers are concerned and numerous systems and devices have been suggested and/or utilized for automatically inspecting glass containers and rejecting those found to be defective for a number of different reasons.

Among the reasons for defective glass containers are those related to the lip or sealing surface of the container and devices have been heretofore suggested for inspecting the lip of a container by means of light directed toward the lip and reflected therefrom so as to be indicative of a defect. See, for example, U.S. Pat. No. 3,631,255.

It has also heretofore been suggested that containers on a conveying line be inspected for foreign objects or defects in the container itself. See, for example, U.S. Pat. No. 3,368,676. Likewise, it has heretofore been suggested that different areas of a container or the profile of the container, can be monitored to determine faults and/or characteristics of the container such as tilt or the like. See, for example, U.S. Pat. No. 3,549,890.

Thus, while many systems have been heretofore suggested and/or utilized for article inspection or monitoring, improvements in such systems are still desirable to enhance the reliability of these systems.

SUMMARY OF THE INVENTION

This invention provides an improved system for monitoring articles for defects and/or for rejecting articles found to be defective. In the system of this invention, a plurality of pulses of radiation are directed to different areas of an article being monitored and upon generation of a predetermined plurality of pulses in predetermined sequence, a defect is indicated when article presence is established. For rejection of articles found to be defective, article presence at the reject location is also established.

It is therefore an object of this invention to provide an improved system for monitoring articles for defects.

It is another object of this invention to provide an improved monitoring and reject system for articles.

It is another object of this invention to provide an improved system for monitoring articles for defects that includes generating a plurality of pulses indicative of defects and producing a defect signal only when a predetermined number of pulses are generated.

It is still another object of this invention to provide an improved system for monitoring articles for defects that includes establishing presence of an article in conjunction with presence of a predetermined plurality and sequence of pulses in order to reliably establish defects in articles.

It is still another object of this invention to provide an improved monitoring and reject system for automatically monitoring articles for defects and automatically rejecting articles found to be defective.

It is yet another object of this invention to provide an improved monitoring system that includes dual unit signal processing paths for processing signals indicative of actual article presence.

With these and other objects in view, which will become apparent to one skilled in the art as the description proceeds, this invention resides in the novel construction, combination, and arrangement of parts substantially as hereinafter described, and more particularly defined by the appended claims, it being understood that such changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which:

FIG. 5 is a block diagram of the ejector system of this invention;

DESCRIPTION OF THE INVENTION

Figure 1:
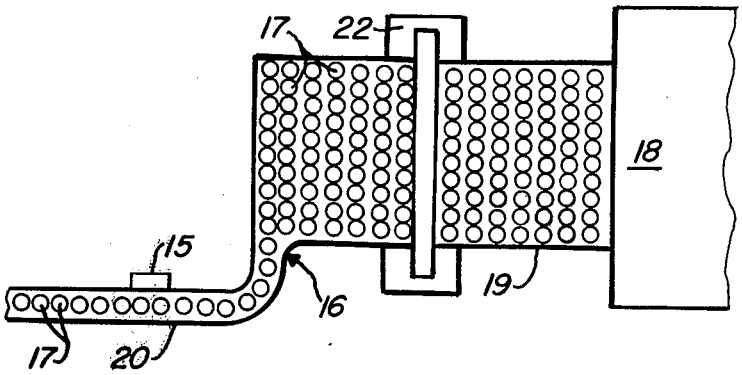
FIG. 1 is a partial flow diagram illustrating positioning of the ejector system of this invention adjacent to a conveyer line for rejecting bottles marked to be defective.

Referring now to the drawings, the ejector, or rejection, system 15 of this invention is indicated in FIG. 1 positioned for typical use in conjunction with an article transfer arrangement, or system, 16. More particularly, and as indicated in FIG. 1, glass articles 17 (typically bottles or jars) are conventionally moved through a lehr 18 by rows on a lehr belt 19. After emerging from the lehr, the glass articles are then conventionally transferred from rows to a single line 20 where the articles may be further processed as, for example, by inspection (not shown) with good ware then being packed as, for example, in cartons or the like (not shown).

The rejector system, or apparatus, 15 of this invention is preferably positioned adjacent to the single line 20 so that each bottle on the line may be successively monitored and if sensed to be defective, the article is automatically ejected from the line. One manner of indicating defective articles is to mark the article as, for example, by placing a non-toxic, non-drying, white fluid thereon, prior to the article being monitored by the rejector system so that the rejector system will reject all articles so marked.

As indicated in FIG. 1, marking can be carried out by an automatic marking apparatus 22 adjacent to the lehr belt 19. Such a marking apparatus is included in U.S.

Pat. No. 4,004,904, entitled "Electronic System for Article Identification" by Robert Thomas Fergusson and assigned to the assignee of the present invention, and, as shown therein, the device remotely marks defective glass bottles emanating from certain glass forming molds. For a more detailed description of such a marking device, see U.S. Pat. No. 4,004,904.

Figure 2:
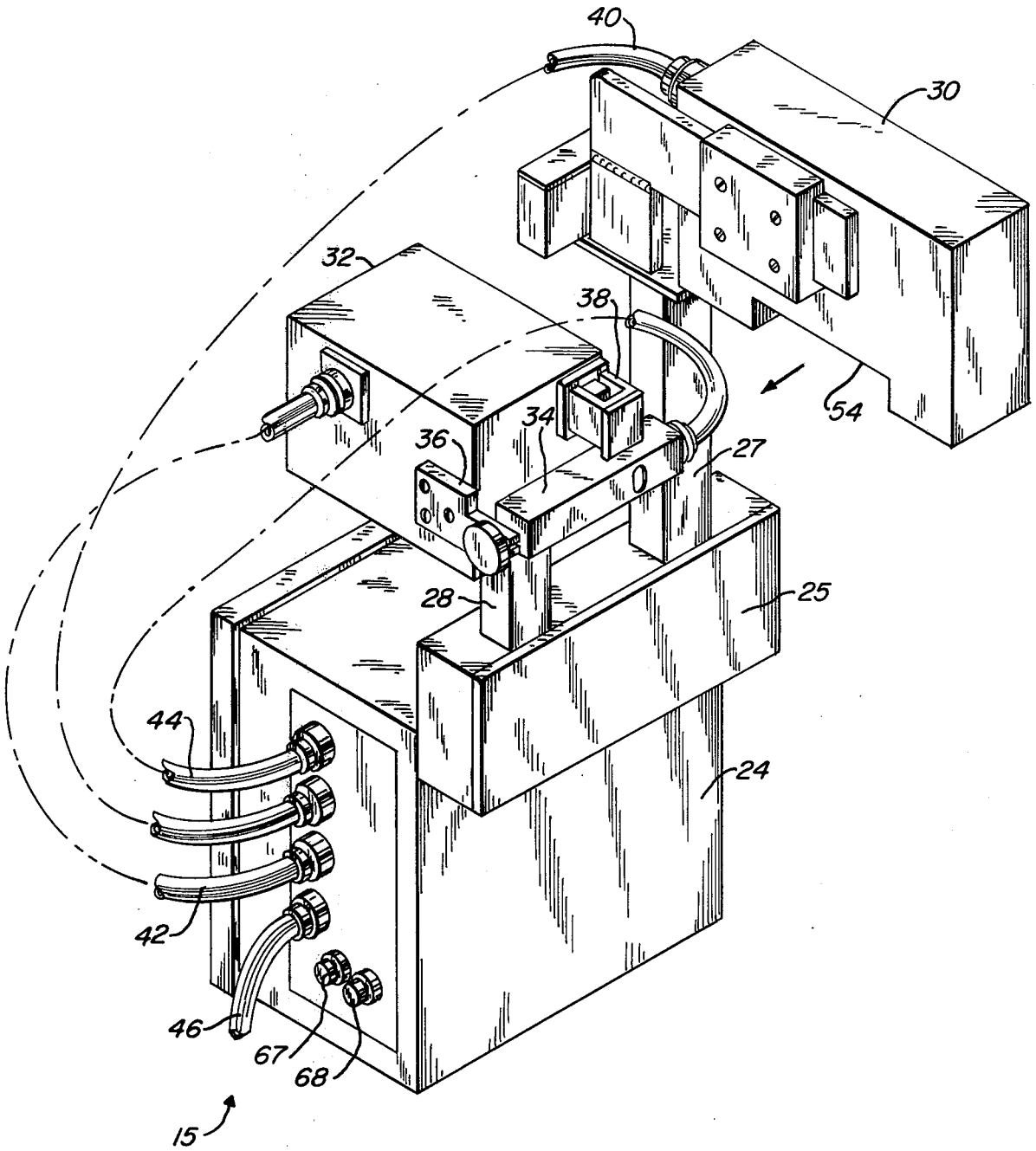
FIG. 2 is a perspective view of the ejector system of this invention.

The rejector system 15 of this invention is shown in FIG. 2 to include a control unit 24 mounted at the top front side of the lower rear portion of bracket assembly 25. Bracket assembly 25 has a pair of upstanding mounting columns 27 and 28. Column 27 has a defect sensing unit 30 mounted at the top and column 28 has a reject, or kicker, unit 32 mounted thereon and extending rearwardly therefrom. A reject sensor unit 34 is mounted at the front side of reject unit 32 by arm 36 and a reject, or kicker, arm 38 extends from the top front of the reject unit.

As can be appreciated from FIGS. 1 and 2, glass containers in single file are transported past the rejector apparatus (in the direction as shown by the arrow in FIG. 2 although the direction could be reversed, if desired, by simple rearrangement of parts) so that the top of the bottle passes through the lower portion of the defect sensing unit 30. The bottle is then conveyed past the reject sensor unit 34 and reject unit 32 so that, when a bottle is to be rejected, the arm is extended to automatically eject the article from the single line as the article is carried past the reject mechanism. As indicated in FIG. 2, control unit 24 is electrically connected with defect sensor 30 through cable 40, and is electrically connected with reject circuit 32 and reject sensor unit 34 through cables 42 and 44, respectively. Power is supplied to the control unit through cable 46, and push button switches 48 and 50 (shown in FIG. 4 to be on the front panel) control application of power to the apparatus and to the reject assembly, respectively.

As indicated hereinabove, the lower portion of defect sensing unit 30 has a recess 54 therein to allow the lip portion of a bottle, such as a wide mouth glass bottle or jar, to pass through the recess. As shown best in FIG. 3, a plurality of light emitters and sensors (20 as shown and indicated generally by the numeral 56 in FIG. 3) are mounted in the recessed lower wall 58 of the defect sensing unit and a light emitter (preferably a light emitting diode) 60 and sensor unit 62 are mounted on opposite sidewalls 64 and 65, respectively, of the recess to provide an inspect window.

Figure 4A:
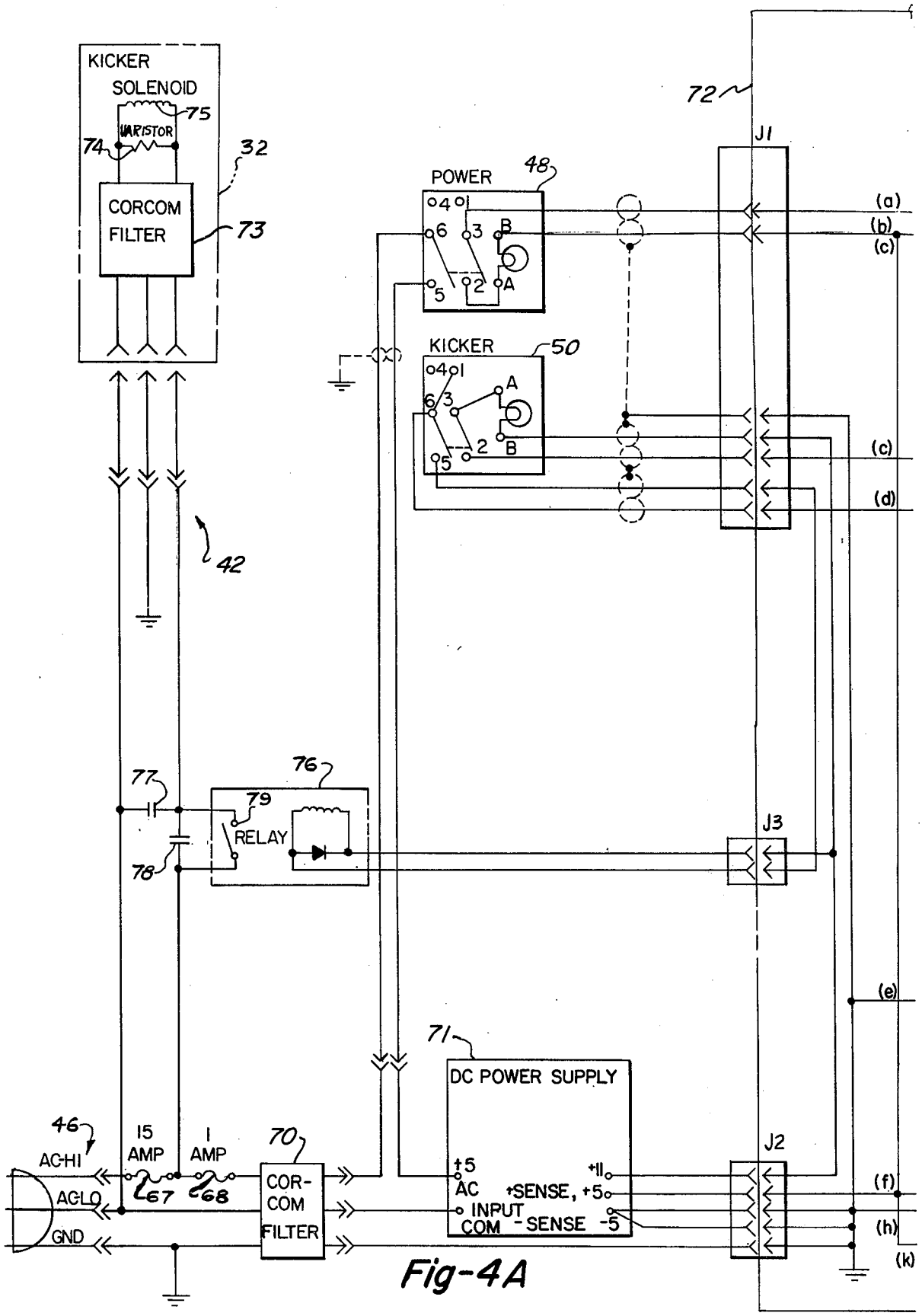
FIG. 4 (A and B) is an electrical schematic drawing showing the interconnection of units of the ejector system as shown in FIG. 2.

The electrical interconnection between units is shown in FIG. 4. An AC input from a conventional power supply (not shown) is coupled to the system through cable 46. AC power is supplied through fuses 67 and 68 and filter 70 to DC power supply 71 (which supplies the P.C. mother board 72 of control unit 24 at junction J2) and through switches 48 and 50 to mother board 72 at junction J1. Kicker, or eject, unit 32 (shown to include a filter 73, a varister 74 and a solenoid 75) is connected to mother board 72 through cable 42 which includes leads from the AC power supply and through relay 76 connected with junction J3 at mother board 72. As shown, a capacitor 77 is connected between leads to kicker unit 32 and a capacitor 78 is connected across the relay switch 79 to relay 76 for noise suppression.

Figure 4B:
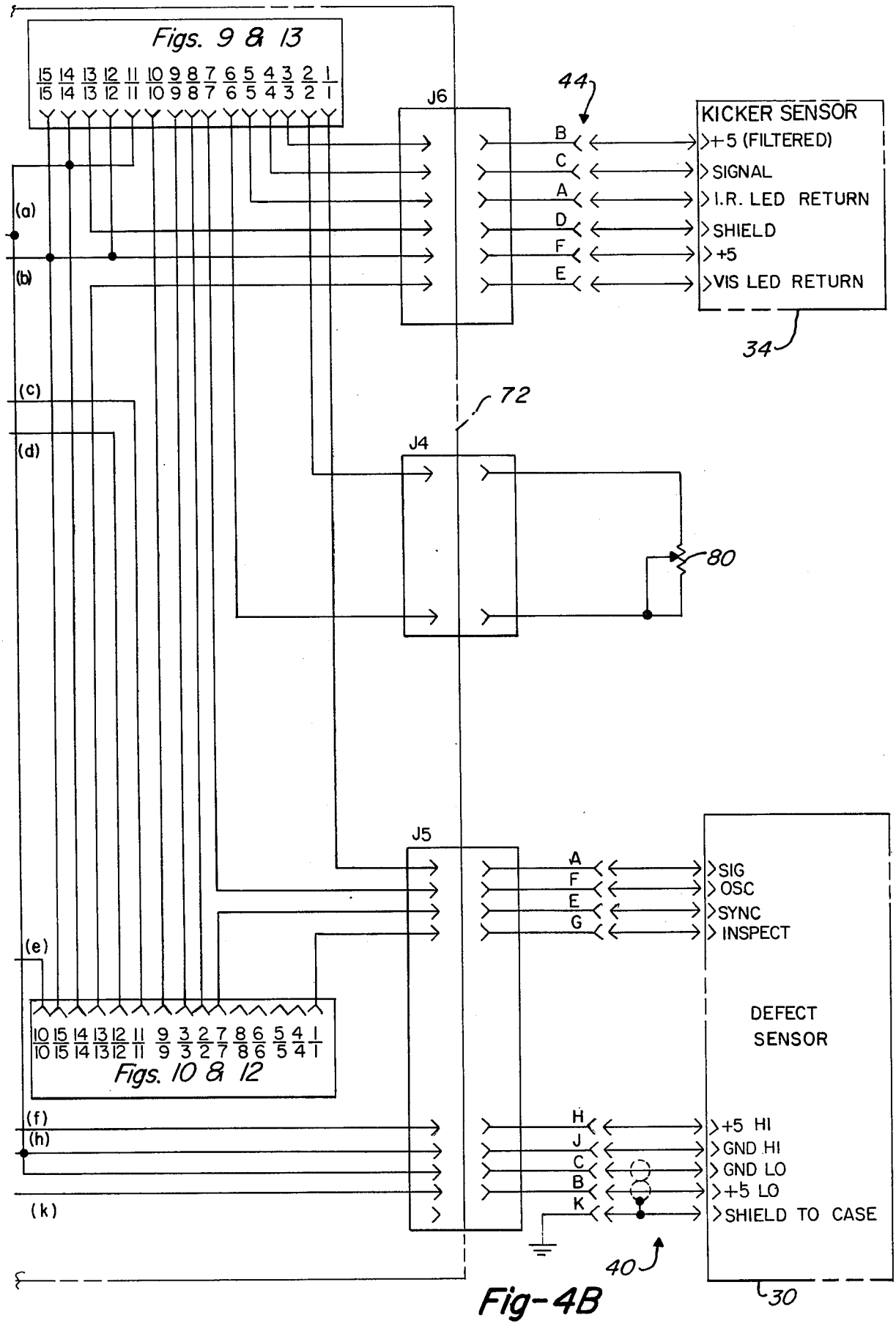

A panel potentiometer 80 is shown in FIG. 4B connected with mother board 72 at junction J4, while defect sensor unit 30 is connected by cable 40 with mother board 72 at junction J5, and kicker or reject, sensor unit 34 is connected by cable 44 to mother board 72 at junction J6. FIG. 4B also shows the interconnection of the various units of FIGS. 9 through 13.

Referring now to FIG. 5, a schematic signal flow diagram of the rejector system of this invention is set forth. As shown, timing, or clock, pulse signals are supplied to the system by a 15 KHz oscillator 83. The timing signals are coupled through drivers to three different light emitter units for scanning of the bottle for defects (or marks indicative thereof), establishing a window indicative of bottle presence, and establishing bottle presence for reject purposes.

Figure 3:
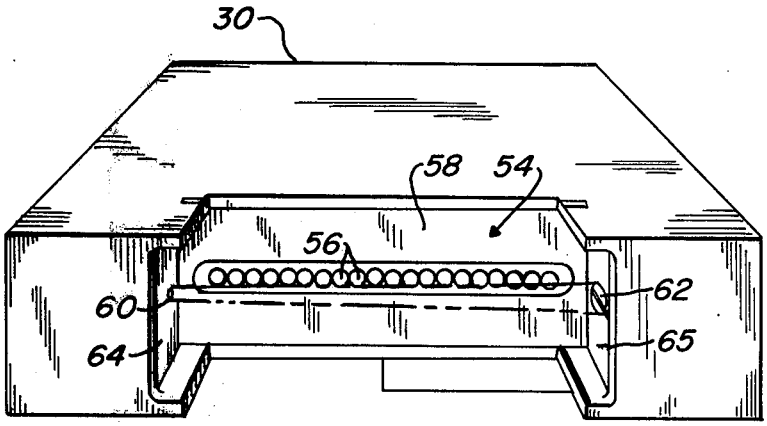
FIG. 3 is a perspective view of the sensor head of the ejector system of this invention as shown in FIG. 2.

A diode coder and driver unit 85 is utilized for successively individually energizing each of the scan diodes and photo transistors 56 in the defect sensor unit 30 (twenty emitter-sensors are indicated in FIG. 3). As each scan diode is energized, it emits light which is directed to the mouth, or lip, 87 of a glass bottle 17 at the inspection area (i.e., in recess 54 of unit 30) with the light then being reflected back to the associated photo transistor if the bottle is defective (i.e., either by being marked or having a defect that is sensed). It has been found preferable to provide five pulses for each diode while energized.

The outputs from the photo transistors are coupled to one-of-twenty sensor decoder 89 for successive readout, and the output from the decoder is coupled through amplifier 91, filter 93, buffer amplifier 95, variable voltage control (potentiometer) 97, amplifier 99 (having a potentiometer 101 connected therewith) and trigger level circuit 103 (also having potentiometer 105 connected therewith) to noise discriminator 107, the output of which is coupled through variable flaw count circuit 109 to reject decision circuit 111. With five pulses provided at the energization of each diode, receipt of all five pulses is required before a reject indication is produced which enhances the reliability of the device. In addition, a plurality of reject indications (i.e., from a plurality of adjacent photo transistors), is necessary for the reject indication to be produced by the system and this further enhances reliability of the system.

The output from oscillator 83 is also coupled through inspect window driver 113 (indicated at a frequency of 1.5 KHz) to light emitting diode (LED) 60 in the sidewall 64 of the recess in unit 30. The light emitted by LED 60 is received by sensor 62 (two sensors are shown in FIG. 5 and can also include conventional buffers) in the opposite sidewall 65 of the recess in unit 30.

Dual output paths 115 and 116 are provided for the inspect window sensors with each path including an amplifier (numbered 118 and 119 having a potentiometer 121 and 122, respectively, connected therewith) and a Schmitt trigger (numbered 124 and 125) with the outputs from the Schmitt triggers being coupled through OR gate 127 and inspect window noise discriminator 129 to the reject decision circuit 111.

The third output from oscillator 83 is coupled through kicker sensor driver 153 to infrared (IR) light emitting diode unit 135 in the reject sensing unit 34. Light from IR LEDs 135 is received by kicker sensor 137 the output from which is coupled through amplifier 139, filter 141, amplifier 143 (having a potentiometer 145 connected therewith), trigger level circuit 147 (having a potentiometer 149 connected therewith) and noise discriminator 151 to reject delay circuit 153. Reject delay circuit 153 also receives an input from reject decision circuit 111 and couples a reset signal back to circuit 111.

The outputs from the reject delay unit 153 are then coupled through kicker driver 155 to actuate the kicker, or reject, arm 38 to reject a bottle indicated to be defective.

Figure 6A:
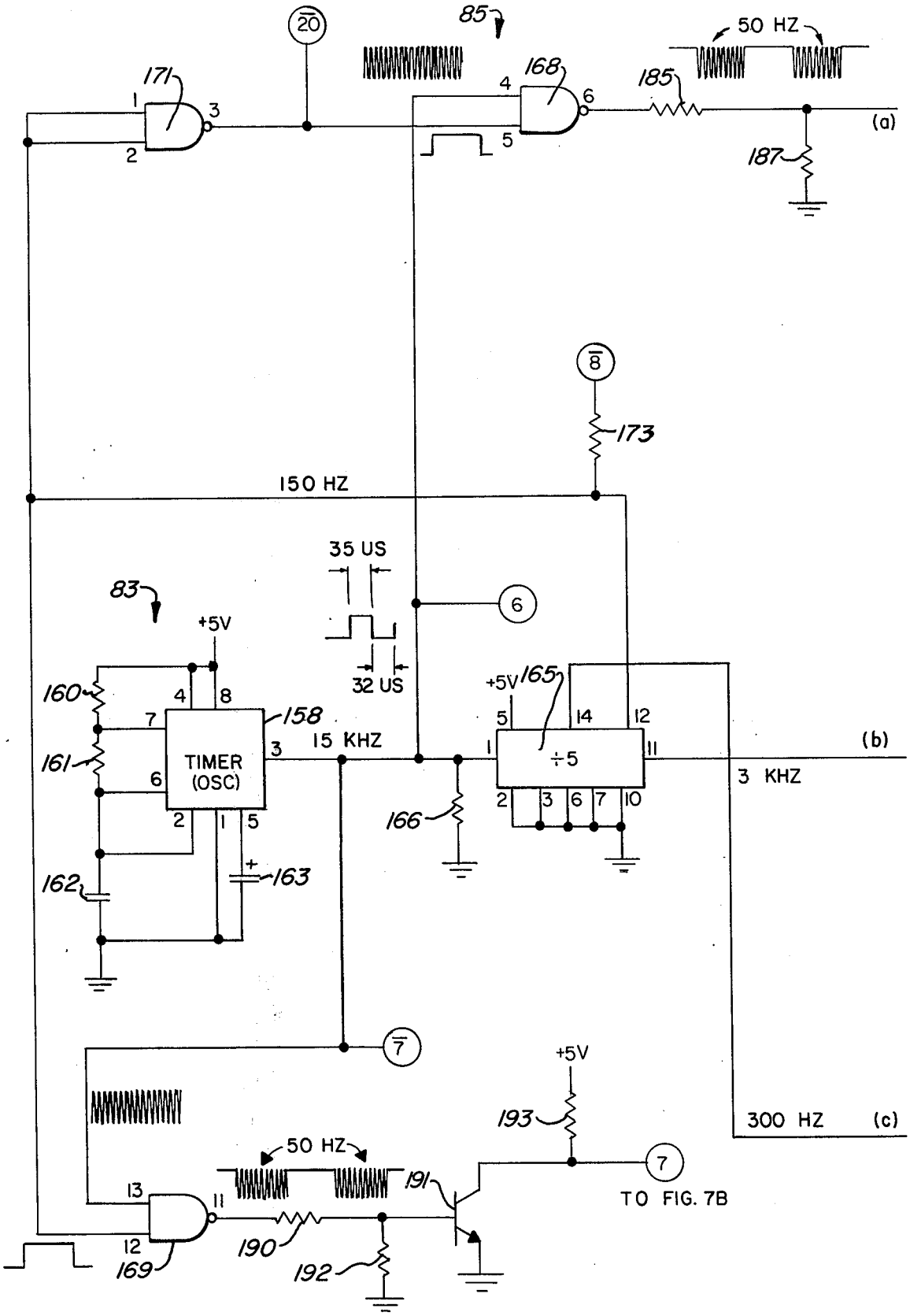
FIG. 6 (A and B) is an electrical schematic of the sensor head.
Figure 6B:
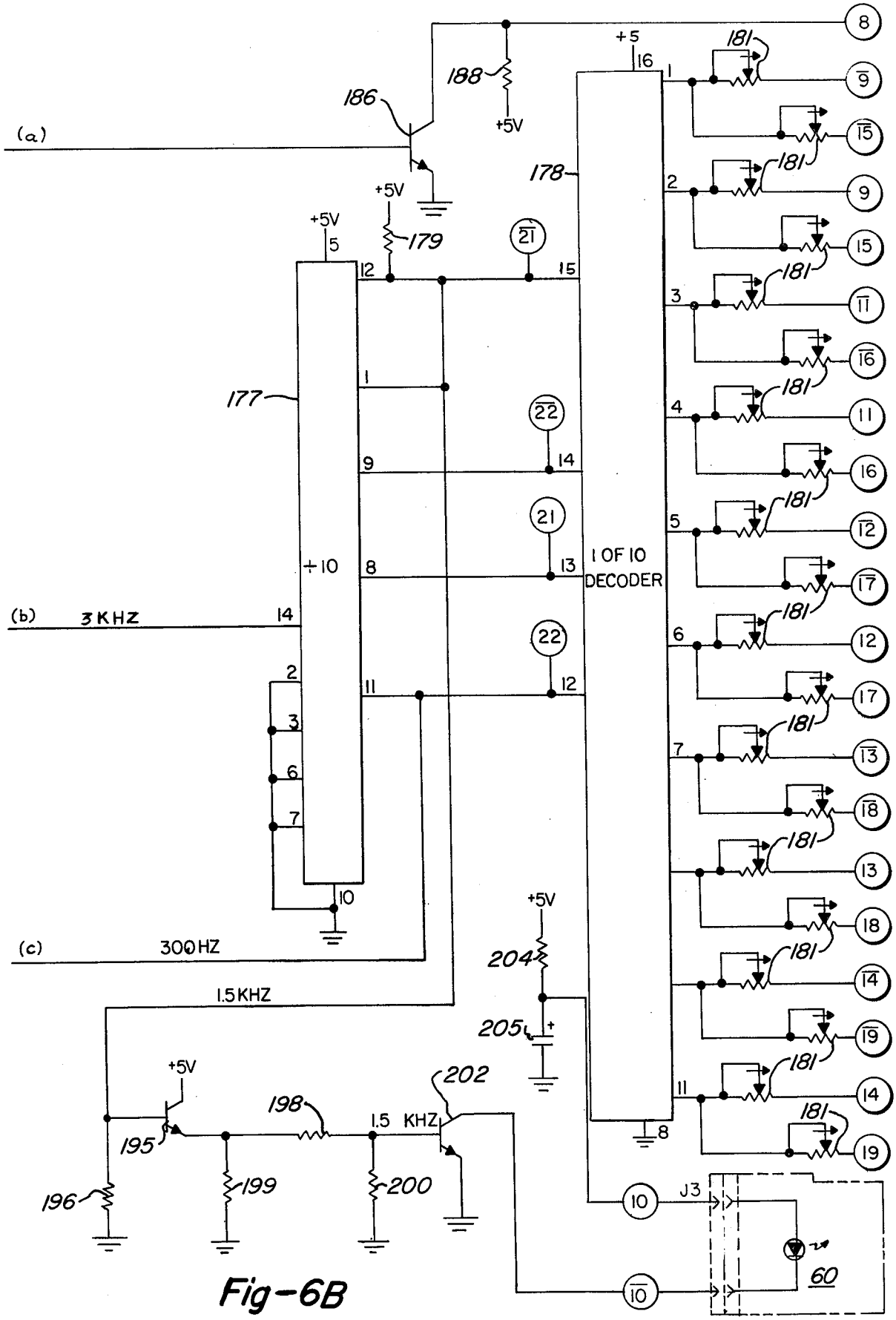
Figure 7A:
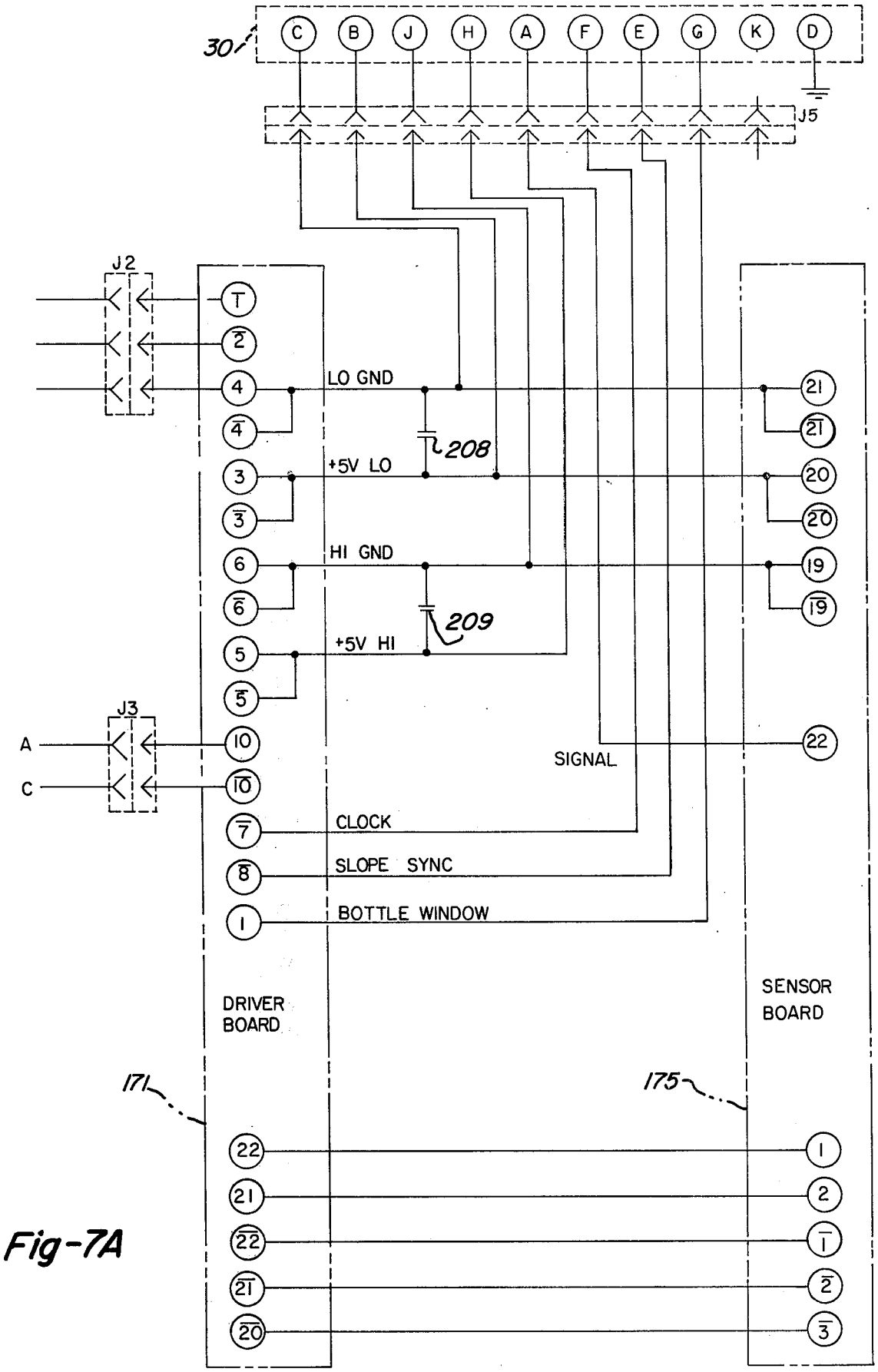
FIG. 7 (A and B) illustrates the electrical interconnection of the sensor head.

Oscillator 83 is shown in FIG. 6 to include timer I.C. 158 having resistors 160 and 161 and capacitors 162 and 163 connected therewith. The output from the oscillator at a frequency of 15 KHz is coupled from pin 3 of timer I.C. 158 and coupled to diode coder and driver circuitry 85. As shown in FIG. 6, the 15 KHz clock signal is coupled to a divide-by-five (÷5) circuit 165 (having resistor 166 connected to the junction), to one input of NAND gates 168 and 169, and to connectors 6 and $\overline{7}$ at driver board 171 (FIG. 7A). A 150 Hertz output from pin 12 of divide-by-five (÷5) circuit 165 is coupled to both inputs of NAND gate 171, as the second input to NAND gate 169, and to connector $\overline{8}$ at driver board 171 (FIG. 7A) through resistor 173. This provides the slope sync signal to pin E of unit 30 as shown in FIG. 7A.

A three KHz output from pin 11 of divide-by-five circuit 165 is coupled to pin 14 of divide-by-ten (÷10) circuit 177 with pin 14 of divide-by-five circuit 165 at a frequency of 300 Hertz being connected with pin 11 of divide-by-ten (÷10) circuit 177. Pins 12 and 1, 9, 8 and 11 of divide-by-ten circuit 177 are connected to pins 15, 14, 13 and 12, respectively, of one-of-ten decoder 178 with pin 15 of decoder 178 being connected through resistor 179 to a +5 volt power source and pins 15, 14, 13 and 12 being connected, respectively, with connectors 21, 22, 21 and 22 of driver board 171 (FIG. 7A).

The ten outputs of one-of-ten decoder 178 are each coupled through a potentiometer (generally designated by the numeral 181) to provide the needed twenty equalized outputs (as designated, in the connections being shown in FIG. 6 and on driver board 183 of FIG. 7B) for successive and sequential energization of the diodes 56 at defect sensor unit 30.

Figure 7B:
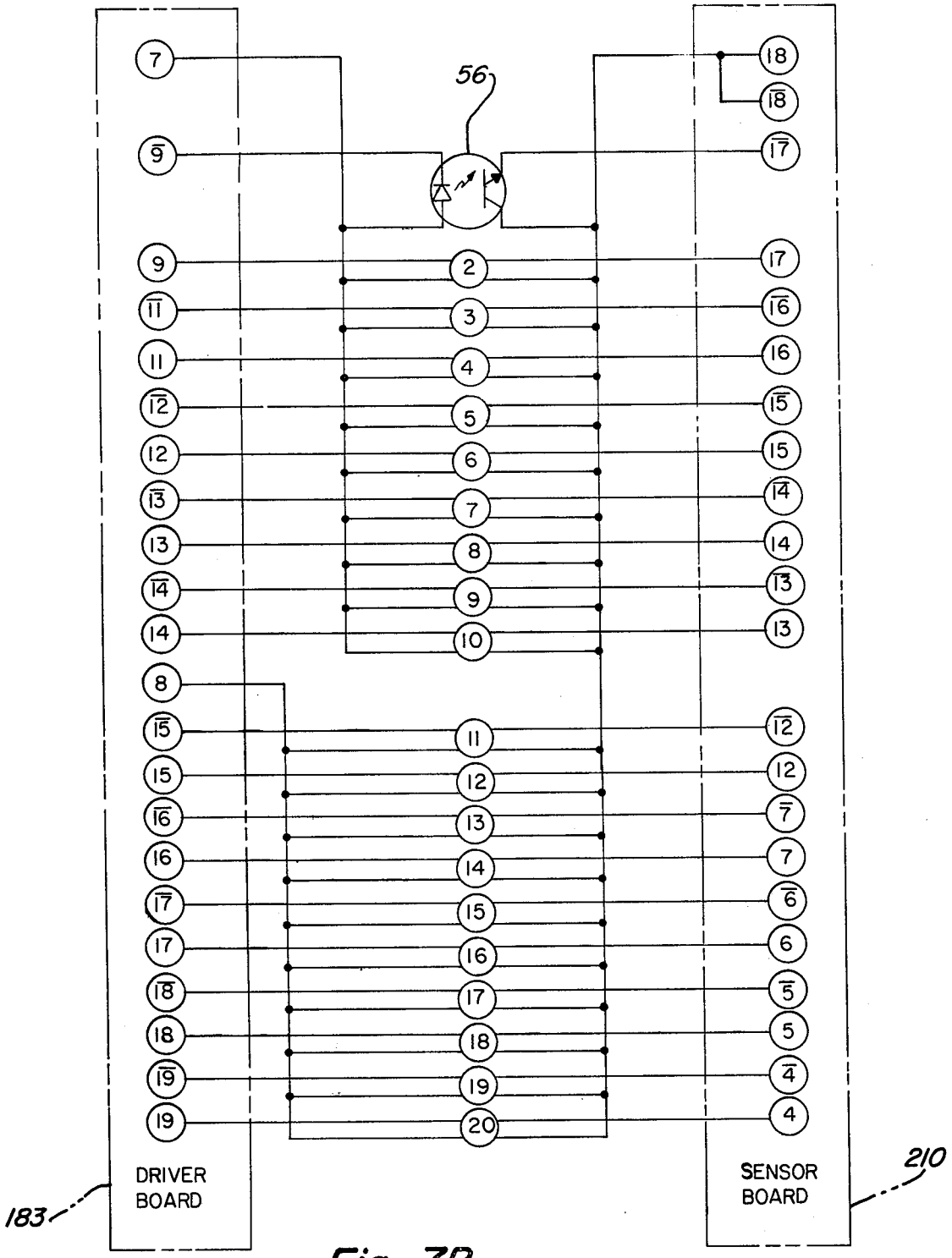

The output from NAND gate 171 is coupled to connector $\overline{20}$ at driver board 171 (FIG. 7A) and as a second input to NAND gate 168. The output from NAND gate 168 is coupled through resistor 185 to the base of transistor 186 (which base also has a resistor 187 to ground connected therewith). The collector of transistor 186 is connected with a +5 volt power supply through resistor 188 and by connector 8 to driver board 183 (FIG. 7B).

The output from NAND gate 169 is coupled through resistor 190 to the base of transistor 191 (which has a resistor 192 to ground connected therewith). The collector of transistor 191 is connected through resistor 193 to the +5 volt power supply and by connector 7 to driver board 183 (FIG. 7B).

A 1.5 KHz output from pin 12 of divide-by-ten circuit 177 is coupled to the base of transistor 195 (which also has a resistor 196 to ground connected therewith). The emitter of transistor 195 is connected through resistor 198 (having resistors 199 and 200 to ground at opposite sides) to the base of transistor 202. The collector of transistor 202 is connected to connection $\overline{10}$ to one input of junction J3 connected with LED 60 (as also shown in FIG. 7A). The other side of LED 60 and junction J3 is connected through connection 10 to the +5 volt power supply through resistor 204 and with ground through bypass capacitor 205.

As shown in FIG. 7A, the connections at driver board 171 are connected with specified connections on sensor board 175 and through junction J5 to specific connections of defect sensor 30 (see FIG. 4). As shown in FIG. 7A, a low noise ground is provided at driver board 171 pins 4 and $\overline{4}$ and sensor board 175 pins 21 and $\overline{21}$, while a +5 volt low noise supply is present at pins 3 and $\overline{3}$ of driver board 171 and at pins 20 and $\overline{20}$ of sensor board 175 with a capacitor 208 being connected between the low noise ground and +5 volts low noise. As also shown in FIG. 7A, a high current ground is provided at pins 6 and $\overline{6}$ of driver board 171 and at pins 19 and $\overline{19}$ of driver board 175, while a +5 volt high power supply is provided at pins 5 and $\overline{5}$ of driver board 171 with a capacitor 209 being connected between high current ground and the +5 volts high current.

As shown in FIG. 7B, ten outputs from one-of-ten decoder 178 (at driver board 183) are connected each to a different one of each of ten emitter-sensors (generally designated by the numeral 56) with a second input thereto being provided through connector 7 at driver board 183. In like manner, the other 10 outputs from one-of-ten decoder 178 (also at driver board 183) are connected each to a different one of each of the other ten emitter/sensors with a second input thereto being provided through connections 8 at driver board 183.

At the output side of the emitter/sensor, the output is individually provided from each sensor unit and coupled to the twenty connections as designated at sensor board 210 (FIG. 7B). In addition, connectors 18 and $\overline{18}$ at sensor board 210 are connected in common with each of the twenty sensors.

Figure 8A:
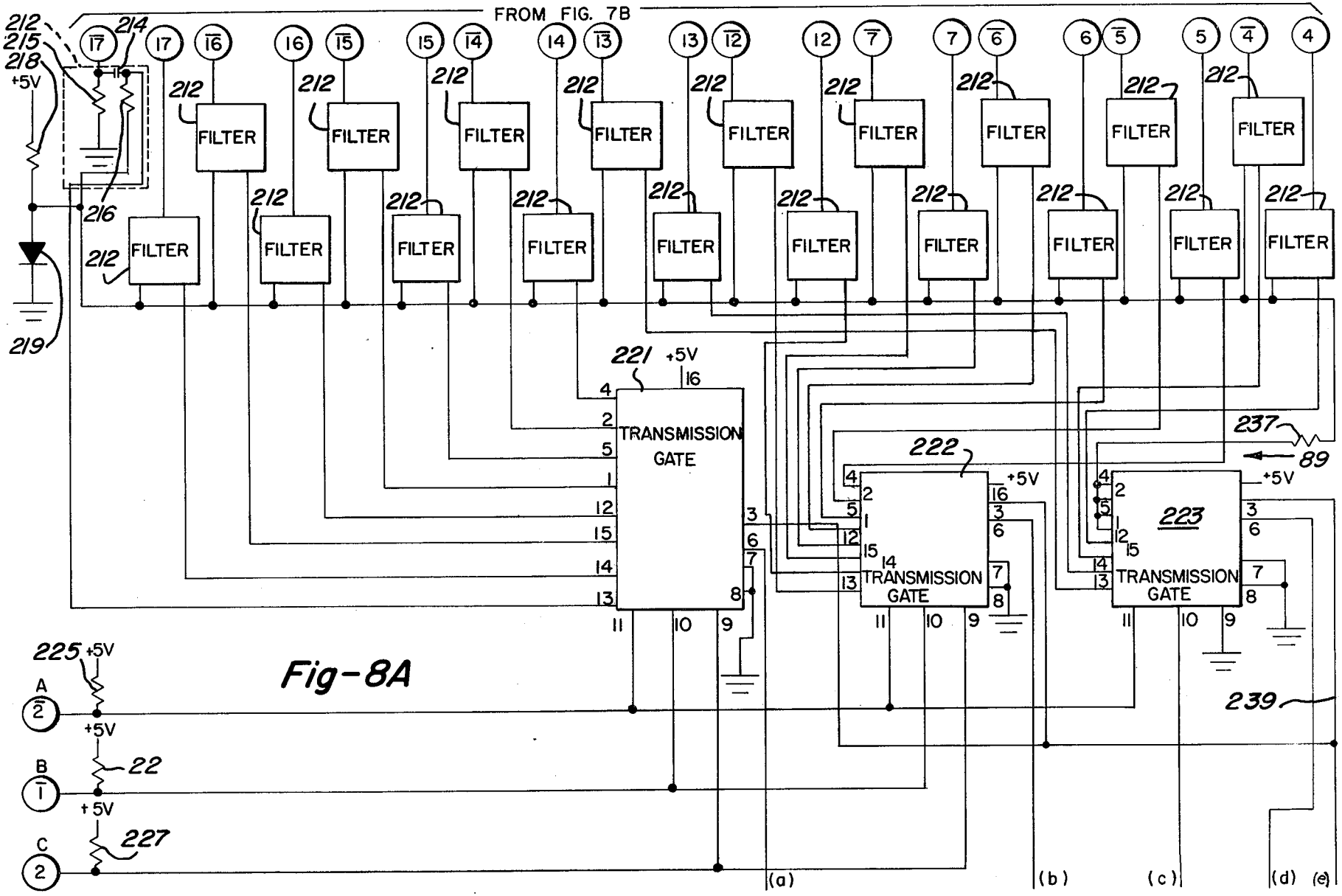
FIGS. 8 (A and B), 9, 10, 11, 12 and 13 (A and B) illustrate in block and schematic form the ejector system of this invention as shown in block form in FIG. 5.
Figure 8B:
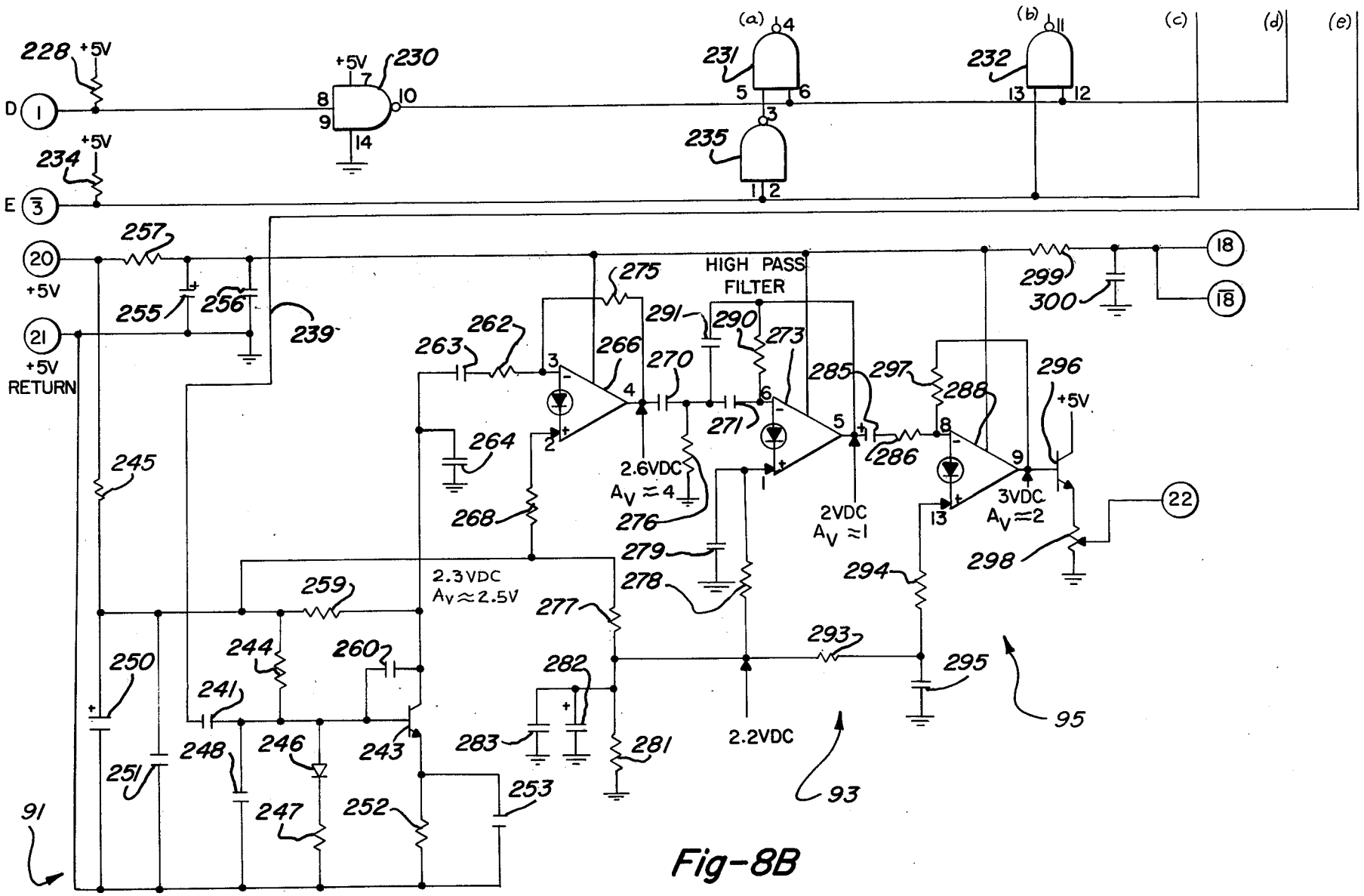

The twenty outputs at sensor board 210, representing the outputs for each of the sensors 56 at defect sensor unit 30, are coupled to sensor decoder circuit 89 which circuit is shown in greater detail in FIG. 8.

As shown in FIG. 8, each input from sensor board 210 is coupled to a filter 212 all of which may be identical (and hence detail is shown only for the input connected with connector $\overline{17}$). As also shown, filter 212 includes a capacitor 214 having a resistor 215 to ground at one side and a resistor 216 connected through a resistor 218 to the +5 volt power supply and with diode 219 to ground. This raises the potential at the second leg of filter 212 so as to minimize clipping of the input signal at ground in transmission gates 221, 222 and 223.

The first eight outputs from filter 212 are coupled to different inputs of first transmission gate 221, while the next eight outputs of the filter are coupled to second transmission gate 222, and the last four outputs from the filter are coupled to third transmission gate 223.

Control signals for the transmission gates are provided by inputs from counters at sensor head 175 (FIG. 7A) connected to receive the clock signal and divisions thereof and provide for simultaneous activation of each similar sensor pair. As shown, connector $\overline{2}$ is connected with pins 11 of gates 221, 222, and 223 (which pins are also connected with a +5 volt power source through resistor 225), connector $\overline{1}$ is connected to pin 10 of gates 221 and 222 (which pins are also connected with a +5 volt power supply through resistor 226), and connector 2 is connected with pin 9 of gates 221 and 222 (which pins are also connected to the +5 volt power supply through resistor 227). Connector 1 (FIG. 8B) is connected with the +5 volt power supply through resistor 228 and through NAND gate 230 to provide one input to NAND gates 231 and 232 connected to pin 6 of gates 221 and 222, respectively. Connection $\overline{3}$ is connected with a +5 volt power supply through resistor 234, to the second input of NAND gate 231 through NAND gate 235, and directly connected to the second input of NAND gate 232 and pin 10 of gate 223. In addition, gate 223 has pins 4, 2, 5 and 1 connected with the junction of resistor 218 and diode 219 through resistor 237.

The outputs from the transmission gates are supplied from pin 3 so that only a single output is applied at any time with each output being successively applied so that it takes twenty outputs to complete a scan of the entire array of sensors.

The output from the transmission gates is coupled on lead 239 to amplifier and filters 91, 93, 95 and 99 (as shown in FIG. 5). As shown, the input on lead 239 is coupled through capacitor 241 to the base of transistor 243. The base of transistor 243 is connected to connector 20 (+5 volts filtered) of scan head 175 (FIG. 7A) through resistor 244 and 245, and is connected with connector 21 (+5 volts return filtered) through series connected diode 246 and resistor 247 (having capacitor 248 in parallel therewith). Connector 21 is also connected with connector 20 through parallel connected capacitors 250 and 251 and to the emitter of transistor 243 through parallel connector resistor 252 and capacitor 253. In addition, connectors 20 and 21 are also connected through parallel connected capacitors 255 and 256 with a small value resistor 257 being connected between capacitors 255 and 256 and connector 20.

The collector of transistor 243 is connected with connector 20 through resistor 259 and with the base through capacitor 260, with the output from the collector being coupled through a filter (which includes resistor 262 and capacitors 263 and 264) to the negative input of current amplifier 266 (a Norton amplifier). The positive input to amplifier 266 is coupled from connector 20 through resistor 245 and resistor 268, while the output from the amplifier is coupled from pin 4 through capacitors 270 and 271 to the negative side of current amplifier 273 (a Norton amplifier configured to be a high pass filter 93—as indicated in FIG. 5). Pin 4 of amplifier 266 is also connected with the negative input through resistor 275 while the junction of capacitors 270 and 271 has a resistor 276 to ground. The positive input to amplifier 273 is connected with connector 20 through resistors 245, 277 and 278, and also has a bypass capacitor 279 to ground. In addition, the junction of resistors 277 and 278 has a resistor 281 and capacitors 282 and 283 connected in parallel to ground.

The output of amplifier 273 is taken from pin 5 and coupled through capacitor 285 and resistor 286 to the negative input of current amplifier 288 (also a Norton amplifier). In addition, pin 5 of amplifier 273 is connected with the negative input through resistor 290 and to the junction of capacitors 270 and 271 with capacitor 291. The positive input to amplifier 288 is coupled from connector 20 through resistors 245, 277, 293 and 294 with the junction of resistors 293 and 294 having a bypass capacitor 295 to ground.

The output from amplifier 288 is coupled from pin 9 to the base of transistor 296 with pin 9 being connected to the negative input of amplifier 288 through resistor 297. The output from transistor 296 is coupled from the emitter through variable potentiometer 298 (forming a voltage divider) to connector 22 of sensor board 175 (FIG. 7A) with connector 22 being connected to connector A of defect sensing unit 30 (FIG. 7A). Connectors 18 and $\overline{18}$ are connected with a +5 volt power supply through resistor 299 having a bypass capacitor 300 to ground.

The output through connector 9-1 (see FIG. 9) is coupled through capacitors 301 (having a bypass capacitor 302 to ground connected therewith) to one side of diodes 304 and 305. Diodes 304 and 305 are connected at the other side through resistor 306 and connector 9-2 to one side of junction J4 (as shown in FIG. 4). This allows a panel mounted potentiometer 80 (see FIG. 4) to be utilized with the one side of the potentiometer being connected through connector 9-6 to the system input of current amplifier 308 (a Norton amplifier).

The positive input to amplifier 308 is coupled from a +5 volt power source through resistor 309, while the output from the amplifier is coupled on pin 9 to the base of transistor 311. Pin 9 of amplifier 308 is connected with the negative input through capacitor 312 while the emitter of transistor 311 is connected with the negative input of amplifier 308 through resistor 313 and with ground through resistor 314.

Figure 9:
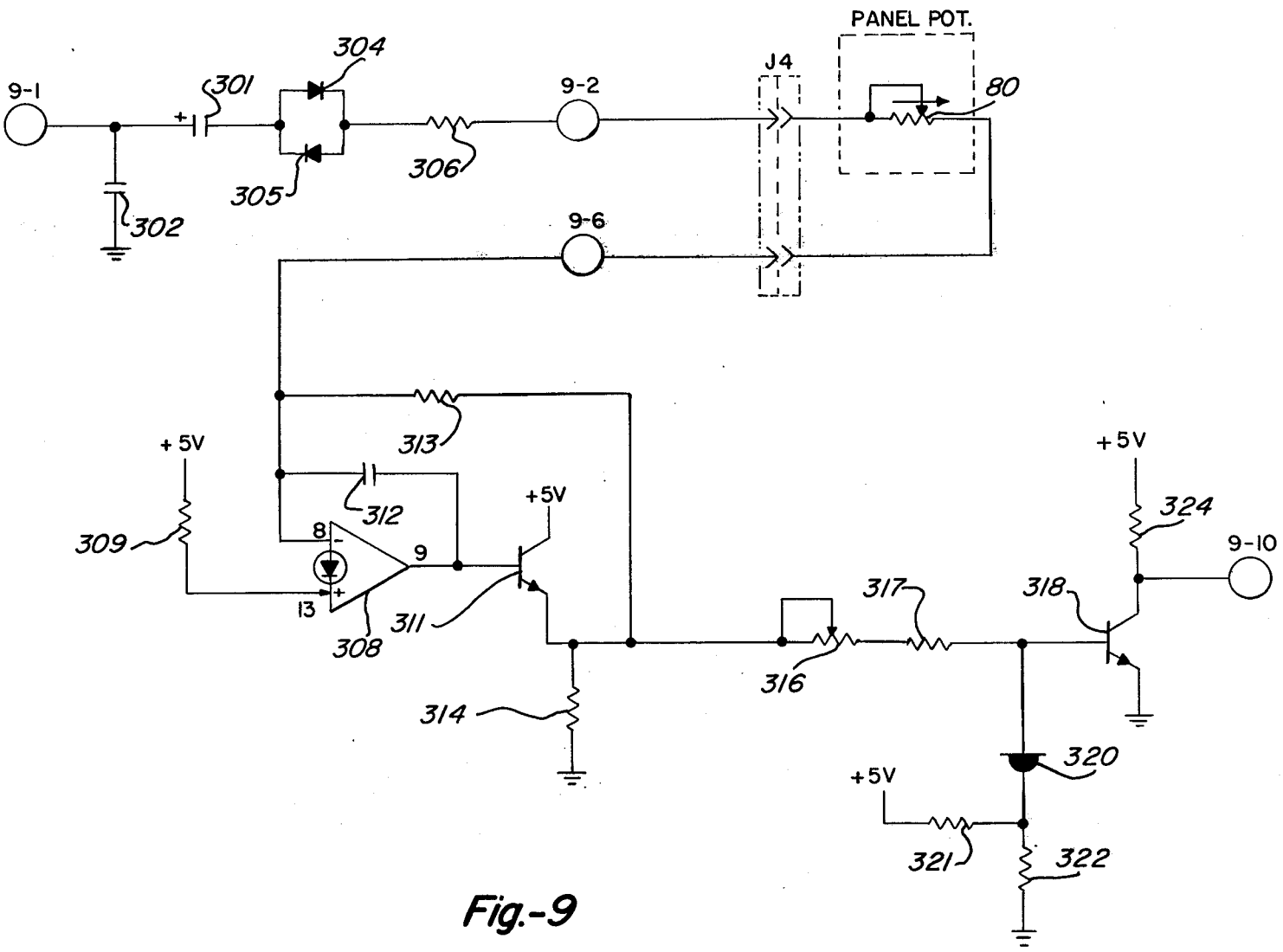

The output from transistor 311 is coupled from the emitter through variable potentiometer 316 and resistor 317 to the base of transistor 318. The base of transistor 318 has a tunnel diode 320 connected to the junction of resistors 321 and 322 connected between a +5 volt power supply and ground. This circuit forms a threshhold detector. The collector of transistor 318 is connected with the +5 volt power supply through resistor 324 and the output from the transistor is coupled from the collector to connector 9-10. As shown in FIG. 4, connector 9-10 of FIG. 9 is connected with connector 10-9 of FIG. 10.

Figure 10:
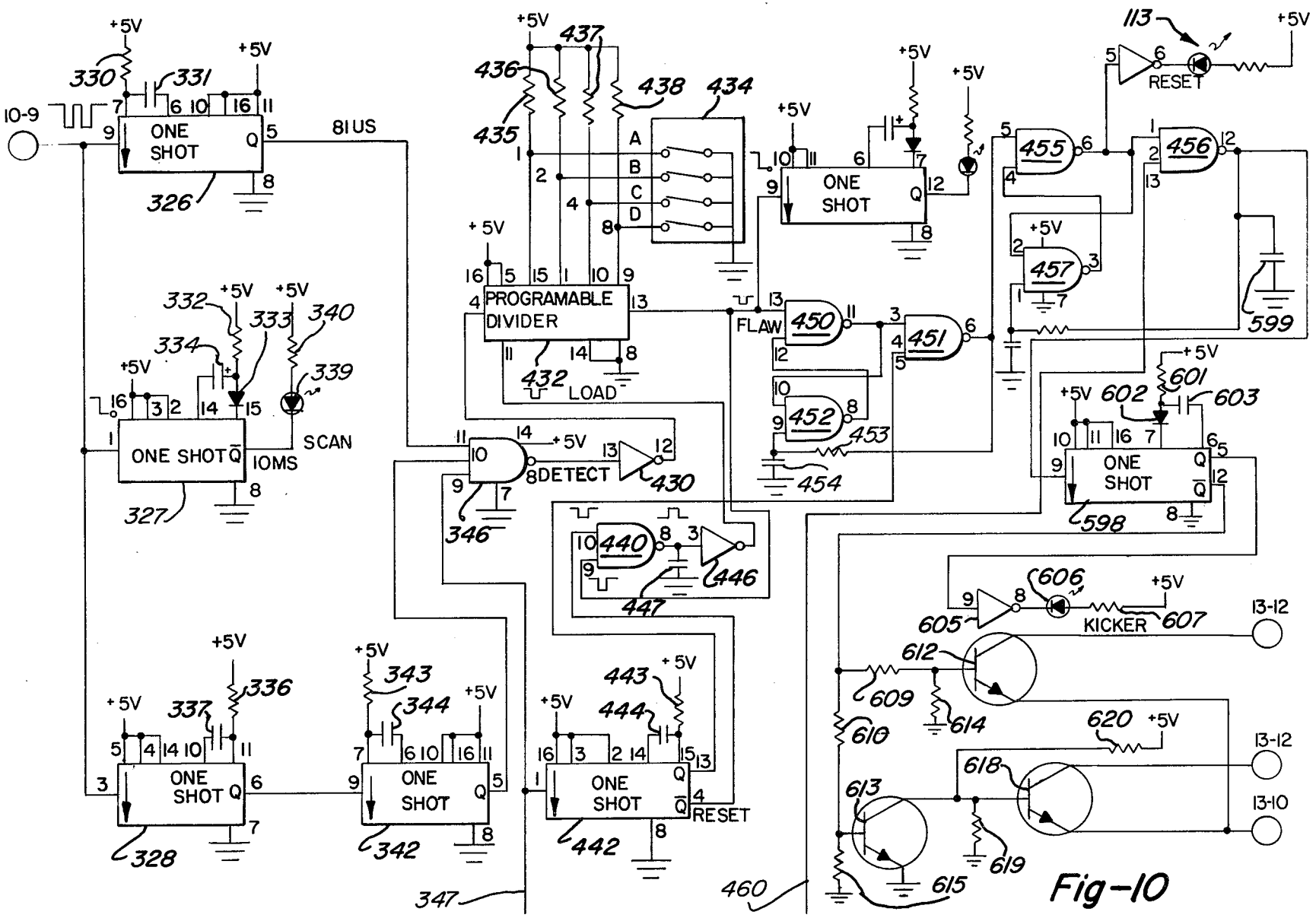

As shown in FIG. 10, the signal coupled from the collector of transistor 318 is coupled to pins 9, 1 and 3 of one shots 326, 327, and 328, respectively. This circuit provides noise discrimination by requiring five pulses at 15 KHz (the number of pulses per emitter/sensor pair) to be received to generate a flaw indicating pulse at the output of NAND gate 346. Pin 7 of one shot 326 is connected through resistor 330 to the +5 volt power supply while pins 6 and 7 are connected through capacitor 331. Pin 15 of one shot 327 is connected with a +5 volt power supply through resistor 332 and diode 333 while the junction of resistor 332 and diode 333 is connected with pin 14 through capacitor 334. Pin 11 of one shot 328 is connected with a +5 volt power supply through resistor 336 and has pins 10 and 11 connected through capacitor 337. The $\overline{Q}$ output of one shot 327 is utilized to energize scan line indicator 339 connected to the +5 volt power supply through resistor 340. This gives a visual indication of receiving a scan. The Q output of one shot 328 is coupled to pin 9 of one shot 342, pin 7 of which is connected to the +5 volt power supply through resistor 343 with pins 6 and 7 being connected through capacitor 344.

Figure 11:
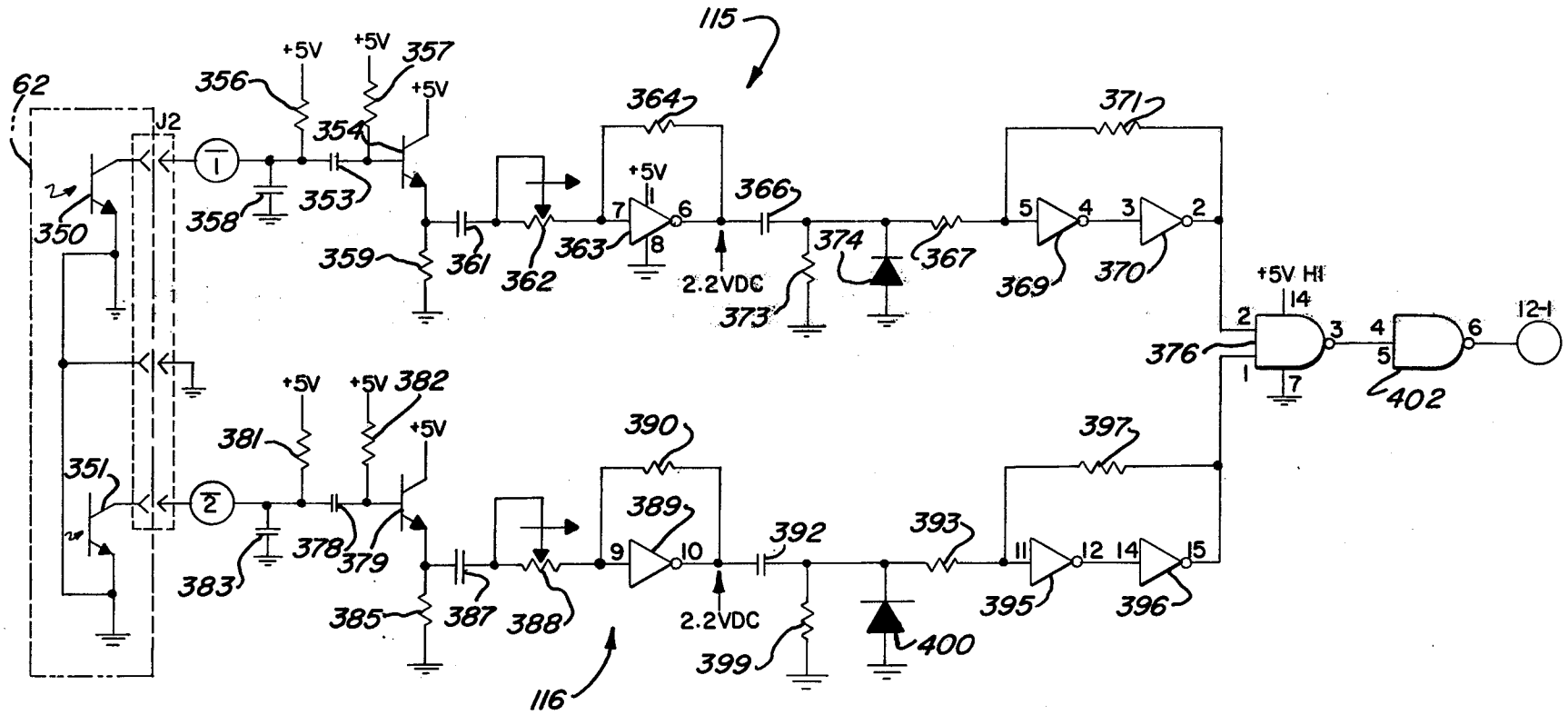
Figure 12:
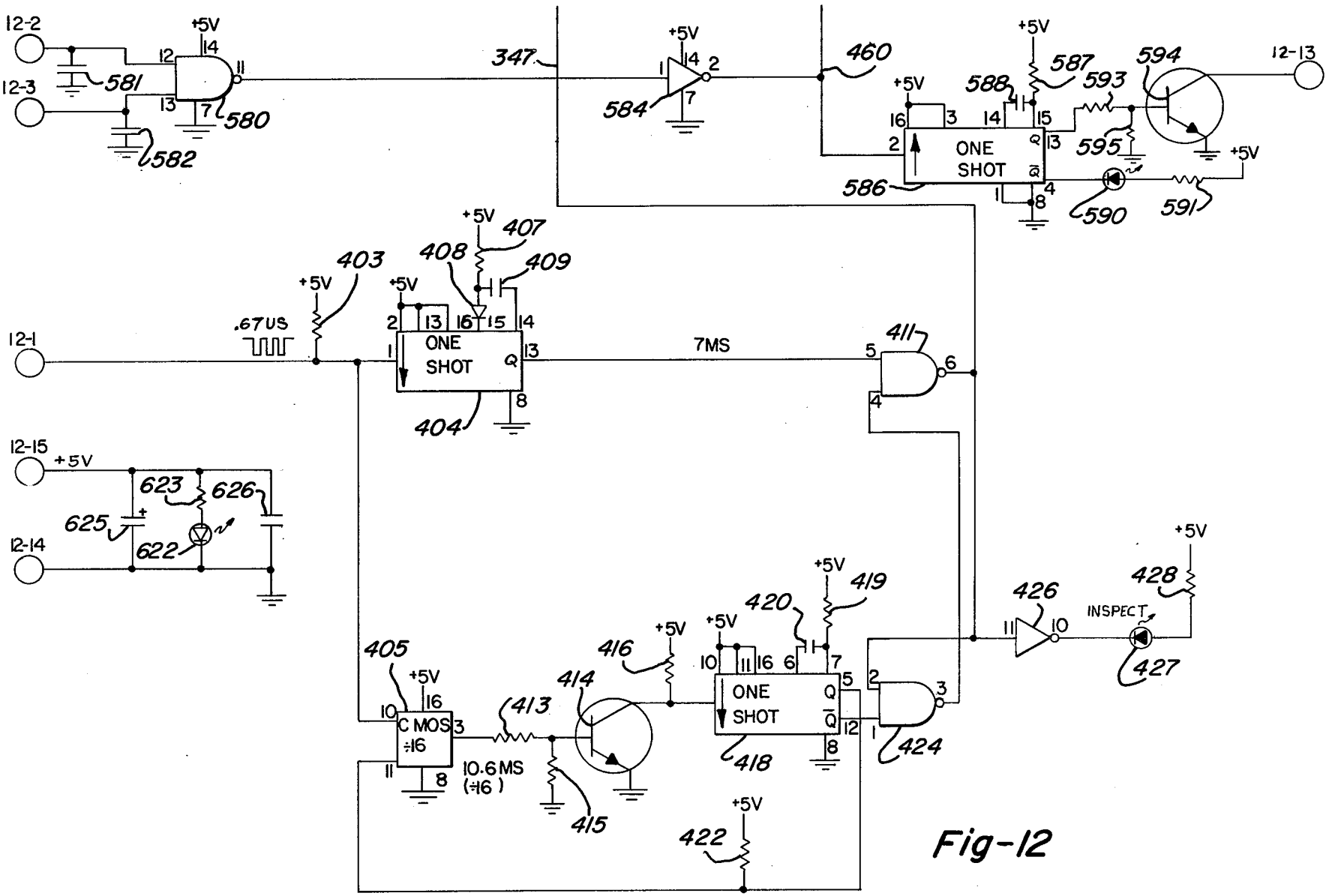

The Q outputs of one shots 326 and 342 are connected to two inputs of NAND gate 346 of noise discrimination circuit 107 (see FIG. 5). The third input to NAND gate 346 is coupled thereto on lead 347 which couples an output from the inspect window circuitry as shown in FIGS. 11 and 12. This gates the circuit on to allow passage of flaw indicating pulses only during that time that an article is being scanned.

As shown in FIG. 11, a pair of sensors 350 and 351 are included in inspect window scan circuitry 62 (see FIG. 5) with the outputs therefrom being coupled on connectors $\overline{1}$ and $\overline{2}$ (as indicated in FIG. 7A) to dual paths 115 and 116 (as indicated in FIG. 5). Thus, the output from sensor 350 is coupled through capacitor 353 to the base of transistor 354 with opposite sides of the capacitor being connected to the +5 volt power supply through resistors 356 and 357 and the input having a bypass capacitor 358 to ground.

Transistor 354 is connected as an emitter follower and is used for impedance matching of the A.C. coupled circuit. This is necessary to enhance the 60 Hz suppression of the circuit. The emitter of transistor 354 is connected with ground through resistor 359 and the output is coupled through capacitor 361 and variable potentiometer 362 to inverting gate 363 having a resistor 364 from output to input. The output from gate 363 is coupled through capacitor 366 and resistor 367 to series connected inverting gates 369 and 370 having a resistor 371 connected across both gates from output to input to form a Schmitt trigger. The junction of capacitor 366 and resistor 367 has a resistor 373 and a diode 374 in parallel to ground thereat, and the output from gate 370 is coupled to one input of NAND gate 376. This shifts the bias of the signal to bring the negative signal to near ground potential.

The second signal path 116 (see FIG. 5) of the dual paths is identical to path 115. The sensor output is coupled through capacitor 378 to the base of transistor 379 with opposite sides of the capacitor being connected to the +5 volt power supply through resistors 381 and 382 and the input having a bypass capacitor 383 to ground. The emitter of transistor 379 is connected with ground through resistor 385 and the output is coupled through capacitor 387 and variable potentiometer 388 to inverting gate 389 having a resistor 390 from output to input. The output from gate 389 is coupled through capacitor 392 and resistor 393 to series connected inverting gates 395 and 396 having a resistor 397 connected across both from output to input. The junction of capacitor 392 and resistor 393 has a resistor 399 and a diode 400 connected in parallel to ground thereat, and the output from gate 396 is coupled as the second input to NAND gate 376.

The output of NAND gate 376 is coupled to NAND gate 402 and is an "OR" function in that if either signal is missing, gate 376 stops the pulse train. The output of NAND gate 402 is utilized for bottle presence indications, and hence could be utilized, if desired, for other utilization purposes (including usage apart from other system circuitry such as the scan diodes, for example), such as, for example, to drive a counter for recording the number of bottles sensed by sensor 62. The output of NAND gate 402 on connector 12-1 (as shown in FIG. 12) is connected with the +5 volt power supply through resistor 403, is coupled to one shot 404 and CMOS divide-by-sixteen (÷16) circuit 405. Pin 15 of one shot 404 is connected with the +5 volt power supply through resistor 407 and diode 408 while the junction of resistor 407 and diode 408 is connected through capacitor 409 to pin 14. The Q output of one shot 404 is coupled as one input to NAND gate 411. In the absence of a signal the Q output is low which locks pin 6 of "R-S Flip-Flop" of gates 411 and 424 in the high condition which indicates article presence in the scan area.

The output of divider 405 is coupled through resistor 413 to the base of transistor 414, which base is connected with ground through resistor 415. The collector of transistor 414 is connected with the +5 volt power supply through resistor 416 and the collector output is coupled to one shot 418. Pin 7 of one shot 418 is connected with the +5 volt power supply through resistor 419 and to pin 6 to capacitor 420 with the Q output of one shot 418 being coupled back as a reset to divider 405 and also having a connection to the +5 volt power supply through resistor 422. The $\overline{Q}$ output from one shot 418 is coupled to one input of NAND gate 424 the output of which is coupled as the second input to NAND gate 411. The second input to NAND gate 424 is connected through inverting gate 426 to one side of inspect indicating light 427, the other side of which light is connected to the +5 volt power supply through resistor 428. When a signal is present on connector 12-1, one shot 404 pin 13 is high and every 16 pulses one shot 418 pin 12 presents a negative pulse to NAND gate 424 pin 1. This sets NAND gate 411 pin 6 low (of R-S Flip-Flop 411 and 424) which indicates that there is no article in view. The output from NAND gate 411 is coupled on lead 347 to NAND gate 346 (as shown in FIG. 10). This circuit provides approximately 8 ms of turn on and turn off delay for hysteresis in the inspect window circuitry.

The output from NAND gate 346 is coupled through inverting gate 430 (FIG. 10) to programable divider circuit 432. A preselect switch 434 is connected with pins 15, 1, 10 and 9 of programable divider circuit 432 and each of these pins is connected with a +5 volt power supply through resistors 435, 436, 437 and 438 respectively. This effects control of divider circuit 432 by setting the division for the circuit.

The flaw output on pin 13 from programable divider circuit 432 is coupled back as one input to NAND gate 440 which receives as a second input to the $\overline{Q}$ output from one shot 442 and serves as an "OR" gate for the reset pulse. One shot 442 receives an input on lead 347 (triggered on the negative edge of the inspect window) and has pin 15 connected with a +5 volt power supply through resistor 443 and to pin 14 through capacitor 444. The output from NAND gate 440 is coupled through inverting gate 446 (having a capacitor 447 to ground at the input side) to pin 11 of programable divider circuit 432. This circuit allows programing a required minimum number of "hits" by the scanning network before a reject decision is made.

The flaw output from pin 13 of programable divider circuit 432 is coupled as one input to NAND gate 450, the output of which gate is coupled as one input to NAND gate 451. The output of NAND gate 451 is coupled back as an input to NAND gate 452 through resistor 453 with the second input to NAND gate 452 being coupled back from the output of NAND gate 450. Pin 9 of NAND gate 452 also has a capacitor 454 to ground. The second input of NAND gate 451 is received from Q output of one shot 442. This circuit is an R-S Flip-Flop which triggers when a flaw indicating signal is received. This signal is passed through gate 451 upon receiving a pulse from one shot 442 at the end of the inspection window. This pulse goes through the delay network to reset the R-S Flip-Flop.

The outputs from NAND gate 451 is coupled to one input of NAND gate 455 with the output of NAND gate 455 being coupled as one input to NAND gate 456. The output of NAND gate 456 is coupled back as one input of NAND gate 457 through resistor 458 and NAND gate 457 receives a second input from the output of NAND gate 455. Pin 1 of NAND gate 457 is connected with ground through capacitor 459. NAND gates 455 and 457 form an R-S Flip-Flop which holds the reject information intact until the signal pulses on line 460 indicate the article is present in front of the kicker and an eject signal is produced by one shot 598. The output of gate 457 is connected as the second input to NAND gate 455. The second input to NAND gate 456 is coupled through lead 460 to the kicker sensor circuitry shown in FIGS. 12 and 13.

Figure 13A:
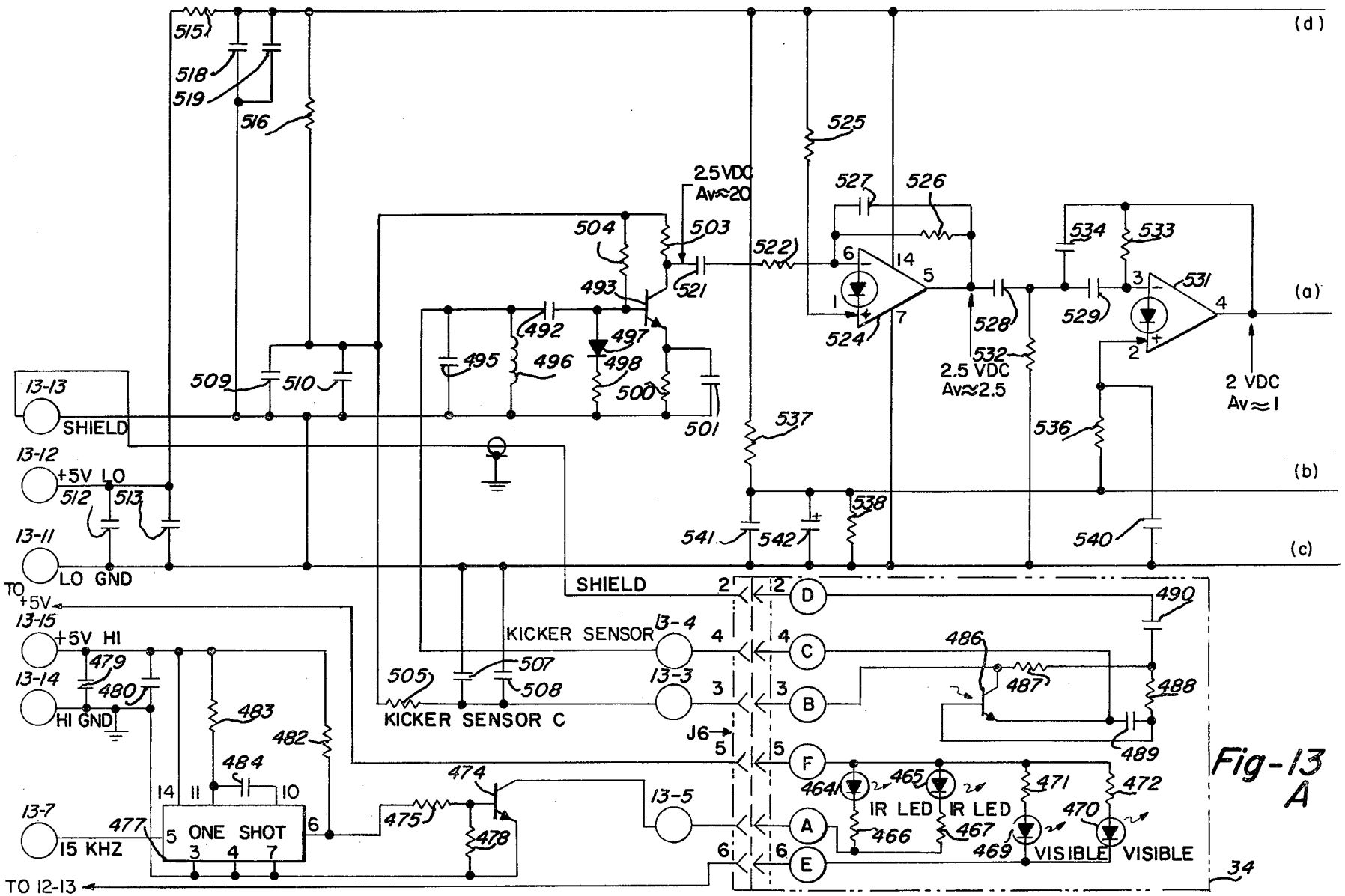
Figure 13B:
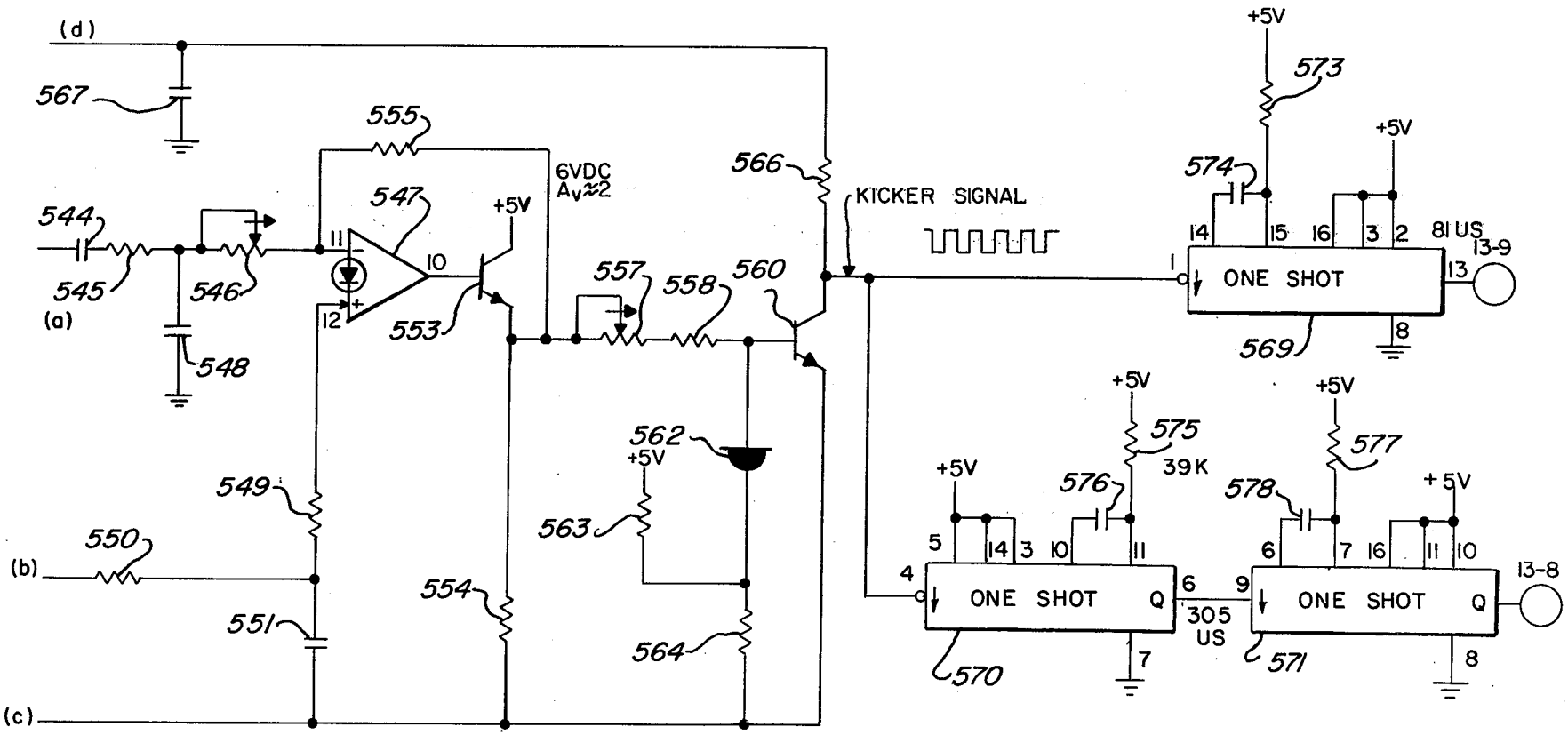

As shown in FIG. 13, kicker, or reject, sensor unit 34 includes a pair of infrared light emitting diodes (IR LEDs) 464 and 465 (of IR LED unit 135) connected in parallel with one another and in series with resistors 466 and 467, respectively. In addition a pair of visible emitters (LEDs) 469 and 470 are connected in parallel with one another and in series with resistors 471 and 472, respectively. The LEDs are connected at one side with the +5 volt power source through connector F (as shown in FIGS. 4 and 13) while the other side of the IR LEDs 464 and 465 are connected through connectors A and 13-5 (FIG. 13) to the collector of transistor 474. The base of driver transistor 474 is connected through resistor 475 to output pin 6 of one shot 477 and to ground through resistor 478. The +5 volt high power and ground are connected through bypass capacitors 479 and 480 in parallel with one another while pins 6 and 11 of one shot 477 are connected with the +5 volt power supply to resistors 482 and 483, respectively, and have pins 10 and 11 connected through capacitor 484. One shot 477 receives the timing signal of 15 KHz at its input and shortens the pulse with from approximately 50% duty cycle to approximately 30% duty cycle. The visible LED connection is through connection E as shown in FIGS. 4 and 13 to connector 12-13 at FIG. 12. The visible LEDs light when an object is within the scanning range of the sensor.

As also shown in FIG. 13, kicker sensor 137 includes optical scan transistor 486 the collector and emitter of which are connected through series connected resistors 487 and 488 and capacitor 489 with the base connected to the junction of resistor 488 and capacitor 489. A shielded connection used to protect the low level signal from noise is established at the junction of resistors 487 and 488 through capacitor 490 and connection D (as shown in FIGS. 4 and 13). The emitter of transistor 486 is connected (through connection C to 13-4 in FIG. 13) through capacitor 492 to the base of transistor 493.

At one side of capacitor 492, parallel connector capacitor 495 and inductor 496 (forming a tuned tank circuit at a 15 KHz bandpass frequency which helps to reduce high frequency noise and 60 Hz light coupled signal) are connected with the shield connection. At the other side of capacitor 492, series connected resistor 497 and diode 498 are connected to the shield connection 13. The emitter of transistor 493 is connected to shield connection through parallel connected resistor 500 and capacitor 501 to further help reduction of 60 Hz, while the collector and base are connected to the collector of optical scan transistor 46 through resistors 503, 504 and 505 through connection 13-3 and B (as shown in FIGS. 4 and 13). Resistor 505 is connected with low noise ground through parallel connector capacitors 507 and 508 at one side and through capacitors 509 and 510 to the shield connection at the other side. The +5 volt low noise power is coupled through connection 13-12 (with parallel connected capacitors 512 and 513 to low noise ground connected thereat) and through resistors 515 and 516 to the junction of resistors 503 and 504 (leading to the collector and base, respectively, of transistor 493). The junction of resistors 515 and 516 have parallel connected capacitors 518 and 519 to the shield connection.

The output from the collector of transistor 493 is coupled through capacitor 521 and resistor 522 to the negative input of current amplifier 524 (a Norton amplifier) which acts as a buffer. The positive input to amplifier 524 is coupled through resistor 525 to the +5 volt power supply, while the output of the amplifier is coupled back to the system input through parallel connector resistor 526 and capacitor 527.

The output from amplifier 524 is coupled through capacitors 528 and 529 to the negative input of current amplifier 531 (a Norton amplifier) which is connected in a high pass filter arrangement. The junction of capacitors 528 and 529 has a resistor 532 to ground and the output of the amplifier is coupled back to the negative input through resistor 533 and to the junction of capacitors 528 and 529 through capacitor 534. The positive input to amplifier 531 is coupled through resistor 536 to the junction of resistors 537 and 538 (connected between the +5 volt power supply and ground) with the positive input being connected with ground through capacitor 540 and the junction of resistors 537 and 538 having parallel capacitors 541 and 542 to ground.

The output from amplifier 531 is coupled through capacitor 544, resistor 545 and variable potentiometer 546 (for gain control) to the negative input of current amplifier 547 (a Norton amplifier). A bypass capacitor 548 to ground is connected at the junction of resistor 545 and potentiometer 546. The positive input to the amplifier is coupled through resistors 549 and 550 the latter of which is connected to the junction of resistors 537 and 538, with the junction of resistors 549 and 550 having a bypass capacitor 551 to ground.

The output from amplifier 547 is coupled to the base of transistor 553 to increase the current output of Norton amplifier 547. The emitter of transistor 553 is connected with ground through resistor 554 to form an emitter follower, and with the negative input of amplifier 547 through resistor 555.

The output from the emitter follower transistor 553 is coupled from the emitter through variable potentiometer 557 and resistor 558 to the base of transistor 560. The base of transistor 560 is connected to the anode side of tunnel diode 562, the other side of which is connected to the junction of resistors 563 and 564 (connected with the +5 volt power supply and ground). This forms a threshhold detector in conjunction with transistor 560. The collector of transistor 560 is connected through resistor 566 to resistor 515 (leading to the +5 volt power supply) and a bypass capacitor 567 to ground is connected therebetween.

The output from transistor 560 is coupled from the collector to the input of one shots 569 and 570, with the Q output of one shot 570 being coupled to one shot 577. Pin 15 of one shot 569 is connected with the +5 volt power supply through resistor 573 and to pin 14 through capacitor 574, pin 11 of one shot 570 is connected to the +5 volt power supply through resistor 575 and to pin 10 through capacitor 576, and pin 7 of one shot 571 is connected to the +5 volt power supply through resistor 577 and to pin 6 through capacitor 578. The output from one shot 569 is coupled through connection 13-9 of FIG. 13 to 12-3 of FIG. 12, while the output of one shot 571 is coupled through connection 13-8 of FIG. 13 to 12-3 of FIG. 12. This arrangement is noise discriminator 151 (see FIG. 5). A train of 15 KHz pulses is required at the inputs of one shots 569 and 570 to supply an output. Random noise will not pass unless it occurs in the form of a 15 KHz pulse train having at least five pulses.

The output from one shots 569 and 571 (FIG. 13) are coupled to the inputs of NAND gate 580 (FIG. 12) each of which has a bypass capacitor (581 and 582) to ground connected therewith. The output from NAND gate 580 is coupled through inverting gate 584 to lead 460 to serve as the second input to NAND gate 456 of FIG. 10 (indicating an article in front of the kicker sensor).

Lead 460 is also connected with the input of one shot 586, which has pin 15 connected with the +5 volt power supply through resistor 587 and with pin 14 through capacitor 588. The $\overline{Q}$ output of one shot 586 is coupled to one side of kicker sensor indicator light 590, the other side of which is connected with the +5 volt power supply through resistor 591. The Q output from one shot 586 is coupled through resistor 593 to the base of transistor 594 with the base being connected with ground through resistor 595. The output from the collector of transistor 594 is coupled through connection 12-13 to the visible LED return for kicker sensor unit 34 to provide for a kicker sensor indication on the kicker sensor itself.

The output from NAND gate 456 in FIG. 10 is coupled to the input of one shot 598 which has a bypass capacitor 599 to ground connected therewith. Pin 7 of one shot 598 is connected with the +5 volt power supply through resistor 601 and diode 602 and the junction of resistor 601 and diode 602 is connected through capacitor 603 to pin 6 of one shot 598. The Q output of one shot 598 is coupled through inverting gate 605 to one side of kicker indicator light 606 the other side of which is connected with the +5 volt power supply through resistor 607. The $\overline{Q}$ output of one shot 598 is coupled through resistors 609 and 610 to the base of transistors 612 and 613, respectively, with the bases of transistors 612 and 613 having resistors 614 and 615 to ground, respectively, connected therewith. One shot 498 provides a pulse of sufficient duration to energize the kicker solenoid.

The collector of transistor 612 is connected through connection 13-11 to provide lamp drive (as indicated in FIG. 4). The collector of transistor 613 is connected to the base of transistor 618, which base has a resistor 619 to ground and a resistor 620 to the +5 volt power supply connected therewith. The collector of transistor 618 is connected to connection 13-12 for lamp and relay driver (as indicated in FIG. 4) while the emitter is connected through connection 13-10 for ground return (as also indicated in FIG. 4).

As shown in FIG. 12, a power indicating light 622 is connected in series with resistor 623 and connections 12-14 and 12-15 leading to the power leads (as indicated in FIG. 4). In addition, a pair of capacitors 625 and 626 are connected in parallel with the indicating lamp and resistor.

In a working embodiment of this invention, the following components have been utilized, it being realized that the listed components are for purposes of illustration only:

Capacitors (UF unless otherwise indicated): 77—0.01; 78—0.01; 162—1000PF; 163—0.01; 205—5; 208—0.1; 209—0.1; 214—0.01; 241—0.1; 248—0.002; 250—100; 251—0.1; 253—0.2; 255—100; 256—0.1; 260—470PF; 263—0.1; 264—0.001; 270—470PF; 271—470PF; 279—0.1; 282—100; 283—0.1; 285—0.01; 291—47PF; 295—0.1; 300—100; 301—1; 302—0.001; 312—100PF; 331—6800PF; 334—1; 337—11000PF; 344—0.001; 353—470PF; 358—0.002; 361—0.1; 366—0.002; 378—470PF; 383—0.002; 387—0.1; 392—0.002; 409—1; 420—330PF; 444—0.003; 447—0.01; 454—0.01; 459—0.01; 479—0.1; 480—100; 484—1000PF; 489—0.001; 490—0.01; 492—0.01; 495—11000PF; 501—0.1; 507—100; 508—0.1; 509—100; 510—0.1; 512—0.1; 513—100; 518—100; 519—0.1; 521—0.002; 527—470PF; 528—470PF; 529—470PF; 534—470PF; 540—0.1; 541—0.1; 542—100; 544—0.1; 548—0.01; 551—0.1; 567—0.1; 574—6800PF; 576—11000PF; 578—0.001; 581—0.01; 582—0.01; 588—0.05; 599—0.01; 603—10; 625—100; and 626—0.1.

Inductor: 496—10 MH

Fuses: 67 and 68—1 amp.

Timer I.C.: 158—NE555.

Current Amplifiers (Norton Amplifiers): 266, 273, 288, 308, 524, 531, and 547—MC3401.

Transistors: 186, 191, 195, 202, 243, 296, 311, 318, 354, 379, 414, 493, 560, 594, and 612—2N3904; and 474, 553, 613 and 618—MJE521.

Resistors (ohms): 160—3.9K; 161—47K; 166—100; 173—10K; 179—2K; 185—100; 187—20K; 188—33; 190—100; 192—20K; 193—33; 196—62K; 198—1K; 199—1K; 200—10K; 204—33; 215—680; 216—680; 218—1K; 225—2K; 226—2K; 227—2K; 228—2K; 234—2K; 237—1K; 244—33K; 245—47; 247—5.1K; 252—510; 257—20; 259—2.7K; 262—5.1K; 268—39K; 275—20K; 276—13K; 277—10K; 278—62K; 281—10K; 286—51K; 290—62K; 293—1K; 294—62K; 297—100K; 299—47; 306—510; 309—1.1 Meg; 313—100K; 314—10K; 317—240; 321—240; 322—24; 324—5.1K; 330—43K; 332—36K; 336—27K; 340—240; 343—39K; 356—5.1K; 357—510K; 359—10K; 364—1 Meg; 367—39K; 371—390K; 373—200K; 381—5.1K; 382—510K; 385—10K; 390—1 Meg; 393—39K; 397—390K; 399—200K; 403—2K; 407—24K; 413—6.8K; 415—20K; 416—5.6K; 419—20K; 422—2K; 428—240; 435—5.1K; 436—5.1K; 437—5.1K; 438—5.1K; 443—20K; 453—100; 458—100; 466—39; 467—39; 471—240; 472—240; 475—200; 482—330; 483—39K; 487—430K; 488—430K; 498—5.1K; 500—510; 503—2.7K; 504—33K; 505—51; 515—20; 516—51; 522—20K; 525—39K; 526—20K; 532—13K; 533—62K; 536—62K; 537—10K; 538—10K; 545—1K; 549—1.1 Meg; 550—1K; 554—10K; 555—100K; 558—620; 563—240; 564—24; 566—6.2K; 573—43K; 575—39K; 577—39K; 587—39K; 591—240; 593—1K; 601—15K; 607—240; 609—330; 610—6.2K; 614—20K; 615—20K; 619—20K; 620—300; and 623—240.

Potentiometers (ohms) 80—0 to 100K; 181—0 to 100; 298—0 to 200; 316—0 to 2K; 362—0 to 100K; 388—0 to 100K; 546—0 to 50K; and 557—0 to 2K.

Diodes: 219, 246, 304, 305, 333, 374, 400, 408, 497 and 602—IN914.

Transmission Gates: 221, 222 and 223—CD4051.

Tunnel Diodes: 320 and 562—IN3712.

Inverting Gates: 363, 369, 370, 389, 395, and 396—4049; and 426, 430, 446, 584, and 605—7404.

NAND Gates: 168, 169, 171, 376, 402, 411, 424, 440, 450, 452, 455, 457 and 580—SN7400; 230, 231, 232 and 235—CD4011; and 346, 451 and 456—SN7410.

One Shot Multivibrators: 326, 327, 342, 404, 418, 442, 569, 571, 586 and 598—SN74123; 328, 477 and 570—SN74121.

Dividers: 165 (÷5)—SN7490; 177 (÷10)—SN7490; 405 ($2^{12}$)—MC14040; and 432 (programable)—SN74193.

Decoder (10f10): 178—SN74145.

Sensors: 350 and 351—L1462; 486—TIL81; 464 and 465 (IR)—TIL31.

Indicator Lamps: 339, 427, 469, 470, 590, 606 and 622—DIALCO 550—0406.

In operation, the system of this invention may be mounted adjacent to the single line conveyor so that the system will automatically monitor, or inspect, each article (i.e. each bottle if adjacent to a glass container line) for defects and automatically rejecting any article found to be defective. When used with a marking unit, the system will reject all bottles marked prior to conveyance to the inspect system (as, for example, bottles found to be defective may be marked at a lehr and then later rejected when in a single line).

The system monitors the bottle by scanning a predetermined portion (as, for example, by scanning the lip of a bottle). To enhance reliability, a plurality of pulses of light are emitted from each emitter (such as a light emitting diode) and the light directed to the portion of the article being monitored. Light pulses reflected (if a defect is found) from the article is received by a light sensor, (such as photo transistor associated with each light emitter) and this causes a plurality of electrical pulses to be produced from each light sensor sensing light pulses indicative of a defect.

The electrical pulses are decoded and if a predetermined number and sequence of pulses are received, a defect indication is produced. For example, when five pulses are emitted by the light emitter, five pulses must be received from the associated light source and five electrical pulses produced or a defect indication is not generated. Likewise, the system reliability is further enhanced and it has been found preferable to require a plurality of electrical pulse outputs from different photo transistors (i.e., two or three different outputs with each having a plurality of pulses in each output). When the selected condition is received, an article presence is established at the monitoring area by an output from a separate light emitting and scanning means, then a defect signal is generated and a reject signal produced in response thereto when article presence is established at the reject area by an output from a third light emitting and scanning means. Upon generation of the reject signal, the article is automatically rejected.

As can be seen from the foregoing, this invention provides an improved system for monitoring and rejecting articles that is particularly well suited for automatically monitoring and rejecting glass containers as they are being conveyed in single file along a conveyor.

What is claimed is:

1. An apparatus for monitoring articles for defects, said apparatus comprising:

a plurality of radiating means each of which emits a plurality of pulses when energized for producing radiation at a monitoring area capable for receiving at least a portion of an article to be monitored for defects;

pulsing means connected with said radiating means to cause each of said radiating means to emit a plurality of pulses of radiation at said monitoring area;

radiation sensing means at said monitoring area adjacent to an article when at said monitoring area to be monitored for defects, said radiation sensing means being connected with said pulsing means and responsive to received radiation indicative of a defect in said monitored article producing a plurality of electrical output pulses indicative of said sensed defect;

article presence sensing means for producing an output signal indicative of the sensed presence of an article at said monitoring area; and signal processing means connected with said radiation sensing means and said article presence sensing means and producing a defect indicating output signal only if a predetermined number of pulses, wherein said number of pulses is greater than one, are received from said radiation sensing means indicative of a sensed fault while article presence is sensed at said monitoring area by said article presence sensing means.

2. The apparatus of claim 1 wherein said radiating means includes a plurality of light emitters for directing light toward an article at said monitoring area, wherein said radiation sensing means includes a plurality of light sensors each of which is positioned to sense light from a different one of said light emitters, and wherein said pulsing means is connected with both said light emitters and light sensors to cause each of the emitters and each of said sensors to be individually and successively energized.

3. The apparatus of claim 2 wherein said pulsing means causes each of said emitters to be energized to produce a plurality of pulses at the same time that an associated sensor is energized to receive said plurality of pulses if a defect is sensed in an article at said monitoring area.

4. The apparatus of claim 3 wherein said pulsing means causes a plurality of pulses of light to be emitted from each of said light emitters in succession, and wherein a plurality of pulses are caused to be produced by each of said sensors that detect a defect in an article at said monitoring area.

5. The apparatus of claim 4 wherein said signal processing means includes flaw count means and decoding means, said decoding means receiving the output from said light sensors and providing separate outputs indicative of each of said sensors to said flaw count means.

6. The apparatus of claim 1 wherein said article presence sensing means includes light emitting means and light sensing means for producing an electrical output signal indicative of sensed article presence at said monitoring area.

7. The apparatus of claim 6 wherein said article presence sensing means includes dual means for providing an electrical output signal indicative of said sensed article presence at said monitoring area.

8. The apparatus of claim 7 wherein said dual means includes a pair of light sensors the output from each of which is coupled through different trigger circuits to a signal combining gate means.

9. The apparatus of claim 1 wherein said apparatus includes reject means receiving the defect indicating output signal from said signal processing means and responsive thereto rejecting articles found to be defective.

10. The apparatus of claim 9 wherein said apparatus includes reject sensing means connected with said signal processing means for sensing presence of an article at said reject sensing means and enabling rejection of an article when said article is positioned for rejection.

11. The apparatus of claim 10 wherein said reject sensing means includes light emitting means and light scanning means for sensing article presence.

12. The apparatus of claim 1 wherein said articles are glass bottles and wherein radiation is reflected from the bottle being monitored to indicate a defect therein.

13. The apparatus of claim 12 wherein defects at said area of said bottle being monitored are marked prior to introduction of said bottles into said monitoring area.

14. The apparatus of claim 1 wherein said article presence sensing means includes a pair of light sensing means, wherein said signal processing means includes a pair of signal paths each of which is connected with a different one of said light sensing means, and wherein said signal processing means also includes gating means having an OR gate connected with both of said signal paths whereby an output signal is produced by said signal processing means if either of said light sensing means senses article presence at said article monitoring area.

15. The apparatus of claim 14 wherein each of said pair of signal paths includes an emitter follower, a signal amplitude control, a signal inverter, and a Schmitt trigger.

16. An apparatus for monitoring articles for defects, said apparatus comprising:

a plurality of radiating means each of which directs radiation, at a monitoring area, toward a predetermined different portion of an article to be monitored for defects;

a plurality of radiation sensing means at said monitoring area with each of said sensing means being positioned to receive radiation from said different portions of an article when at said monitoring area and producing electrical outputs responsive thereto;

pulsing means connected with said radiating and sensing means to cause each of said radiating means to be individually energized to emit a plurality of pulses toward one of said predetermined portions whenever energized, and to enable a plurality of pulses of radiation to be received by one of said radiation sensing means from said one predetermined portion each time that a corresponding radiating means is energized to emit said plurality of pulses to said one predetermined portion, said pulsing means causing each of said radiation sensing means to be successively engerized so that after successive energization of all of said radiating and sensing means each of said different portions of said article to be monitored for defects have been scanned by subjection to a plurality of radiation pulses so that each of said radiation sensing means sensing a defect is caused to produce a plurality of electrical output pulses indicative of said sensed defect; and signal processing means connected with said plurality of radiation sensing means and providing a defect indicating output signal only if a predetermined number of pulses, wherein said number of pulses is greater than one, are received indicative of a sensed defect.

17. The apparatus of claim 16 wherein said plurality of radiating means includes a plurality of scan diodes and wherein said plurality of radiation sensing means includes a plurality of photo transistors.

18. The apparatus of claim 16 wherein said signal processing means includes means for providing a defect indicating signal only if a predetermined number of pulses are received from a plurality of radiation sensing means.

19. An article monitoring and reject system, comprising:

a plurality of scan diodes each of which emits light toward different preselected portions of an article at a monitoring area to be scanned for defects;

a plurality of photo transistors equal in number to said plurality of scan diodes with each of said photo transistors being associated with a different one of said scan diodes to receive light emitted from said associated scan diode upon reflection from said preselected portion of articles then being scanned, said photo transistors providing an output indicative of received light reflected from said article;

pulsing means connected with said scan diodes and photo transistors for causing each of said scan diodes to be individually energized to emit a plurality of pulses, and for causing said scan diodes to be successively energized to cause said plurality of pulses to be produced successively by each of said scan diodes whereby each of said photo transistors are caused to produce a plurality of electrical output pulses when the associated scan diode is energized and a defect is sensed by reflection of said emitted light to said associated photo transistor;

monitor sensing means at said monitoring area, said monitor sensing means including light emitting and sensing means to produce an output indicative of article presence at said monitoring area;

signal processing means for receiving said electrical output pulses from said photo transistors and said output from said monitor sensing means and producing a defect indicating signal only if a predetermined number and sequence of pulses are received by said signal processing means with article presence at said monitoring area established;

reject sensing means at a reject area, said reject sensing means including light emitting and sensing means to produce an output signal indicative of article presence at said reject area;

reject enabling means connected to receive said defect indicating signal from said signal processing means and said output signal from said reject sensing means and producing a reject signal in response to predetermined receipt of said signals; and reject means connected to receive said reject signal from said reject enabling means and responsive thereto causing rejection of said article when at said reject area.

20. The system of claim 19 wherein said pulsing means includes a diode coder connected with said scan diodes and said photo transistors.

21. The system of claim 19 wherein said signal processing means includes decoding means for receiving the output pulses from all of said photo transistors.

22. The system of claim 19 wherein said monitor sensing means includes dual path processing means connected with said sensing means of said light emitting and sensing means.

23. The system of claim 19 wherein said reject enabling means includes reject delay circuitry receiving said output signal from said reject sensing means.

24. The system of claim 19 wherein said light emitting and sensing means of said reject sensing means includes light emitting diodes operating at infrared frequencies.

25. The system of claim 19 wherein said system is mounted adjacent to a bottle conveying line and wherein bottles are conveyed through said monitoring area and then through said reject area whereby a plurality of bottles are automatically monitored and those found to be defective are automatically rejected.

26. The system of claim 25 wherein said system includes means to mark bottles on said conveyer line that have been found defective prior to conveyance to said monitoring area.

* * * * *